US006603292B1

(12) United States Patent
Schouten et al.

(10) Patent No.: US 6,603,292 B1
(45) Date of Patent: Aug. 5, 2003

(54) LDO REGULATOR HAVING AN ADAPTIVE ZERO FREQUENCY CIRCUIT

(75) Inventors: Andre Schouten, Inverkip (GB); Steve O'Kane, Inverclyde (GB)

(73) Assignee: National Semiconductor Corporation, Santa Clara, CA (US)

( * ) Notice: Subject to any disclaimer, the term of this patent is extended or adjusted under 35 U.S.C. 154(b) by 0 days.

(21) Appl. No.: 09/834,216

(22) Filed: Apr. 11, 2001

(51) Int. Cl.[7] ..... G05F 1/573
(52) U.S. Cl. ..... 323/277; 323/274
(58) Field of Search ..... 323/316, 313, 323/273, 280, 274, 277

(56) References Cited

U.S. PATENT DOCUMENTS 4,823,070 A * 4/1989 Nelson ..... 323/285
5,686,821 A * 11/1997 Brokaw ..... 323/273
6,201,379 B1 * 3/2001 MacQuigg et al. ..... 323/313
6,229,289 B1 * 5/2001 Piovaccari et al. ..... 323/268

* cited by examiner

*Primary Examiner*—Shawn Riley
(74) *Attorney, Agent, or Firm*—Wagner Murabito & Hao LLP

(57) ABSTRACT

A low dropout voltage (LDO) regulator having an adaptive zero frequency circuit is described. The adaptive zero frequency circuit maintains the stability of the LDO regulator and improves the transient response of the LDO regulator under a range of values for the output current, whereas the output current inversely varies with the load resistance coupled to the output of the LDO regulator. The adaptive zero frequency circuit generates a zero having a frequency which varies with the output current. Hence, the frequency of the zero changes to maintain the stability of the LDO regulator despite the variation in the frequency of the low-frequency pole generated by the load resistance and the load capacitance (or output capacitor) coupled to the output of the LDO regulator.

37 Claims, 16 Drawing Sheets

LDO REGULATOR HAVING AN ADAPTIVE ZERO FREQUENCY CIRCUIT

BACKGROUND OF THE INVENTION

1. Field of the Invention

The present invention generally relates to low dropout voltage regulators. More particularly, the present invention relates to the field of frequency compensation schemes for low dropout voltage regulators.

2. Related Art

The phenomenal growth in portable, battery-operated devices has fueled the growth of the low dropout voltage (LDO) regulator market. The LDO regulator is characterized by its low dropout voltage. Dropout voltage is the difference between the input voltage (unregulated voltage received from an unregulated source, such a battery or a transformer) to the LDO regulator and the output voltage (regulated voltage) from the LDO regulator. Typically, the output voltage of the LDO regulator drops out of regulation if the dropout voltage is not maintained. The low dropout voltage of the LDO regulator extends the life of the battery since the LDO regulator provides a regulated voltage even if the battery is discharged to a value that is within (typically) 100–500 millivolts of the regulated voltage. The LDO regulator is incorporated into portable devices such as cellular phones, cordless phones, pagers, personal digital assistants, portable personal computers, camcorders, digital cameras, etc.

FIG. 1 illustrates a conventional LDO regulator 100 according to the prior art. As illustrated in FIG. 1, the conventional LDO regulator 100 includes a pass device 10 which provides an output current $I_{out}$ which drives the load resistance 50 coupled to the output 30 of the conventional LDO regulator 100. The conventional LDO regulator 100 receives the unregulated voltage $V_{in}$ and provides the regulated voltage $V_{out}$ at its output 30. Typically, a capacitor $C_{output}$ (the load capacitor) is coupled to the output 30 of the conventional LDO regulator 100 to improve the transient response of the conventional LDO regulator 100. Moreover, the manufacturer of the capacitor $C_{output}$ models the parasitic elements inside the capacitor $C_{output}$ by assigning an Equivalent Series Resistance (ESR) to the capacitor $C_{output}$, whereas the ESR is positioned in series with the capacitor $C_{output}$.

To obtain a low dropout voltage, the pass device 10 is implemented as a PNP transistor coupled in the common-emitter configuration. Additionally, a low dropout voltage can be obtained if the pass device 10 is implemented as a p-type channel MOSFET (PMOS) coupled in the common-source configuration.

The PMOS (or the PNP transistor) implemented as the pass device 10 adds an additional low-frequency pole in the transfer function which provides the frequency response of the conventional LDO regulator 100. Moreover, the frequency of this low-frequency pole is dependent on both the value of the load resistance 50 and the value of the capacitor $C_{output}$. The load resistance 50 varies widely from application to application and even within a particular application. Hence, the low-frequency pole has a variable frequency. The presence of the low-frequency pole (having the variable frequency) requires the utilization of a dominant pole compensation scheme as well as an additional compensation scheme. Typically, the additional compensation is achieved by introducing a well-defined zero. This well-defined zero is provided by the capacitor $C_{output}$ and the ESR of the capacitor $C_{output}$.

Typically, the manufacturer of the conventional LDO regulator 100 specifies for each value of the capacitor $C_{output}$, a minimum value and a maximum value for the ESR to ensure the stability of the conventional LDO regulator 100 under a range of load resistances 50. Often, the manufacturer specifies an expensive and bulky capacitor $C_{output}$ to target a precise combination of capacitance and ESR. Typically, electrolytic capacitors and tantalum capacitors are bulky and expensive compared to ceramic capacitors. Moreover, electrolytic capacitors and tantalum capacitors have an ESR which can be several Ohms while ceramic capacitors have an ESR which is typically between several milliohms and several hundred milliohms. The goal is to achieve a capacitor $C_{output}$ whose ESR is neither too high nor too low to maintain the stability of the conventional LDO regulator 100 and to keep it from oscillating.

Typically, the required ESR value for a specified value of the capacitor $C_{output}$ ranges from hundred(s) of milliohms to several Ohms. Although ceramic capacitors are preferred because of their limited space requirements and cost advantages, this range of values for the ESR generally prohibits the use of ceramic capacitors for the capacitor $C_{output}$, unless an additional resistor is added in series with the capacitor $C_{output}$.

SUMMARY OF THE INVENTION

A low dropout voltage (LDO) regulator having an adaptive zero frequency circuit is described. The adaptive zero frequency circuit maintains the stability of the LDO regulator and improves the transient response of the LDO regulator under a range of values for the output current, whereas the output current inversely varies with the load resistance coupled to the output of the LDO regulator. The adaptive zero frequency circuit generates a zero having a frequency which varies with the output current. Hence, the frequency of the zero changes to maintain the stability of the LDO regulator despite the variation in the frequency of the low-frequency pole generated by the load resistance and the load capacitance (or output capacitor) coupled to the output of the LDO regulator.

Moreover, the Equivalent Series Resistance (ESR) of the output capacitor is no longer critical for maintaining the stability of the LDO regulator. Therefore, a broad range of capacitor types can be implemented as the output capacitor, including a ceramic capacitor. The ceramic capacitor requires a minimal amount of space on a printed circuit board and is significantly less expensive than other capacitor types, such as an electrolytic capacitor or a tantalum capacitor. Moreover, the ceramic capacitor has a small ESR compared to the ESR of an electrolytic capacitor or a tantalum capacitor. The transient response of the LDO regulator is improved by using an output capacitor having a small ESR.

These and other advantages of the present invention will no doubt become apparent to those of ordinary skill in the art after having read the following detailed description of the preferred embodiments which are illustrated in the drawing figures.

In one embodiment, the present invention includes a frequency compensation circuit for a low dropout voltage (LDO) regulator having an amplifying stage and a pass device stage, comprising: a current sensing circuit coupled to the pass device stage, the current sensing circuit generating a sense current that varies with an output current generated by the pass device stage; and an adaptive zero frequency (AZF) circuit coupled to the current sensing circuit, coupled to a ground terminal of the LDO regulator, and coupled to an output terminal of the amplifying stage, wherein the AZF circuit generates a zero in a frequency response of the LDO regulator, and wherein the zero has a frequency which varies with the sense current so that to maintain stability in the LDO regulator and to improve transient response of the LDO regulator under a range of values for the output current.

In another embodiment, the present invention includes a low dropout voltage (LDO) regulator comprising: an error amplifier having an amplifying stage and a pass device stage, the error amplifier generating a regulated voltage at an output of the LDO regulator; a current sensing circuit coupled to the pass device stage, the current sensing circuit generating a sense current that varies with an output current generated by the pass device stage at the output of the LDO regulator; and an adaptive zero frequency (AZF) circuit coupled to the current sensing circuit, coupled to a ground terminal of the LDO regulator, and coupled to an output terminal of the amplifying stage, wherein the AZF circuit generates a zero in a frequency response of the LDO regulator, and wherein the zero has a frequency which varies with the sense current so that to maintain stability in the LDO regulator and to improve transient response of the LDO regulator under a range of values for the output current.

BRIEF DESCRIPTION OF THE DRAWINGS

The accompanying drawings, which are incorporated in and form a part of this specification, illustrate embodiments of the invention and, together with the description, serve to explain the principles of the present invention.

The drawings referred to in this description should not be understood as being drawn to scale except if specifically noted.

DETAILED DESCRIPTION OF THE INVENTION

Reference will now be made in detail to the preferred embodiments of the present invention, examples of which are illustrated in the accompanying drawings. While the invention will be described in conjunction with the preferred embodiments, it will be understood that they are not intended to limit the invention as defined by the appended claims. Furthermore, in the following detailed description of the present invention, numerous specific order to provide a thorough understanding of the present invention. However, it will be recognized by one of ordinary skill in the art that the present invention may be practiced without these specific details. In other instances, well known methods, procedures, components, and circuits have not been described in detail as not to unnecessarily obscure aspects of the present invention.

Figure 1:
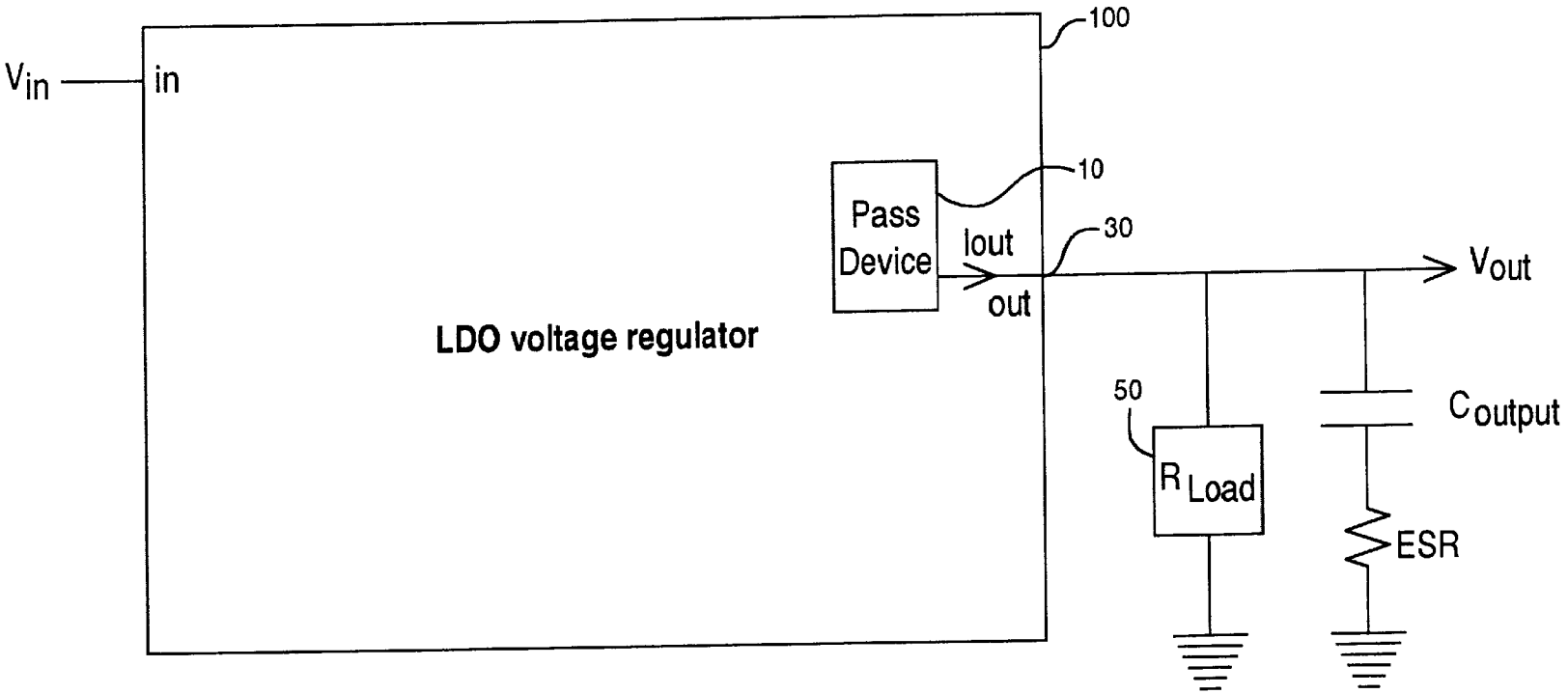
Figure 1 (Prior Art)
FIG. 1 illustrates a conventional LDO regulator 100 according to the prior art.
Figure 2:
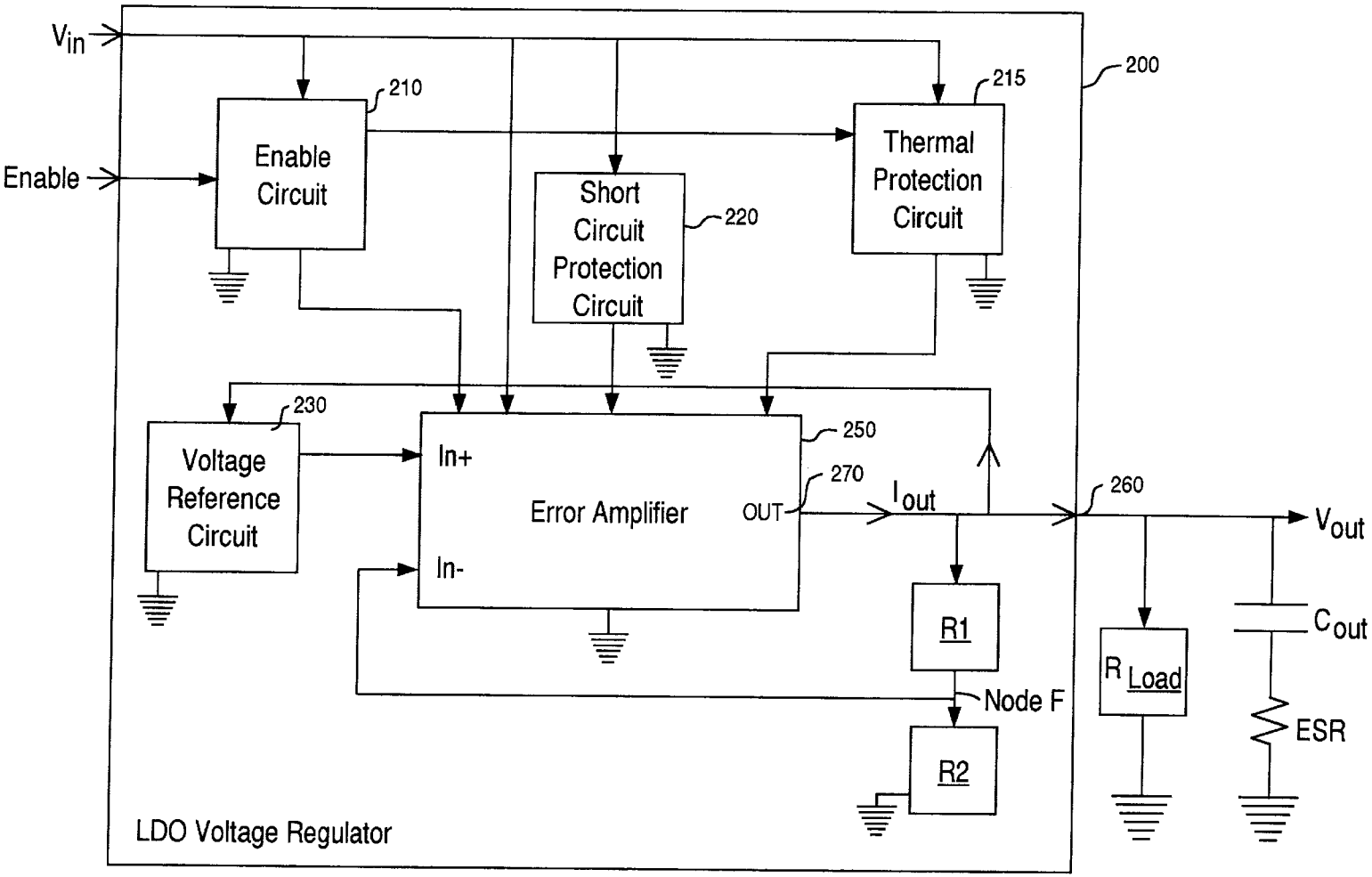
FIG. 2 illustrates a block diagram of an LDO regulator according to an embodiment of the present invention.

FIG. 2 illustrates a block diagram of an LDO regulator 200 according to an embodiment of the present invention. The low dropout voltage (LDO) regulator 200 receives an unregulated input voltage $V_{in}$ from an unregulated voltage source such as a battery, a transformer, or any other type of unregulated voltage source. Moreover, the LDO regulator 200 generates at its output terminal 260 a regulated output voltage $V_{out}$ which can be coupled to a load (e.g., processor, sensor, etc.) in a variety of applications. In addition, the LDO regulator 200 generates an output current $I_{out}$ which inversely varies with the load resistance $R_{load}$ of the load coupled to the output terminal 260. The relationship between the output current $I_{out}$ and the load resistance $R_{load}$ is approximately given by the equation:

$$I_{out}=V_{out}/R_{load}. \quad \text{(Eq. 1)}$$

Hence, since $V_{out}$ is approximately a constant value, an increase in the load resistance $R_{load}$ causes a decrease in the output current $I_{out}$ Moreover, a decrease in the load resistance $R_{load}$ causes an increase in the output current $I_{out}$. In an embodiment, the LDO regulator 200 generates a regulated output voltage $V_{out}$ having the approximate value 2.8 volts while the output current $I_{out}$ can range approximately from 0 Amps to 80 milliamps. It should be understood that the regulated output voltage $V_{out}$ and the range for the output current $I_{out}$ can have other values.

In an embodiment, the LDO regulator 200 has an enable circuit 210, a thermal protection circuit 215, a short circuit protection circuit 220, a voltage reference circuit 230, an error amplifier 250, a first feedback resistor R1, and a second feedback resistor R2. In an embodiment, the LDO regulator 200 is comprised of integrated circuits formed with BiCMOS technology components. It should be understood that the LDO regulator 200 can be configured in numerous other configurations.

The enable circuit 210 is coupled to the unregulated input voltage $V_{in}$, the signal ENABLE, the thermal protection circuit 215, the error amplifier 250, and the ground terminal of the LDO regulator 200. The enable circuit 210 receives the signal ENABLE as an input. The signal ENABLE causes the enable circuit 210 to turn on (or activate) or to turn off (or disable) the LDO regulator 200, permitting control of the operation of the LDO regulator 200. Moreover, the enable circuit 210 reduces the discharge rate of the battery (the unregulated voltage source) which provides the unregulated input voltage $V_{in}$. In an embodiment, the enable circuit 210 generates one or more bias currents and one or more bias voltages for the circuits in the LDO regulator 200.

The thermal protection circuit 215 is coupled to the unregulated input voltage $V_{in}$, the enable circuit 210, the error amplifier 250, and the ground terminal of the LDO regulator 200. In an embodiment, the thermal protection circuit 215 protects the LDO regulator 200 by turning off (or disabling) the LDO regulator 200 if the temperature of the LDO regulator 200 rises to a threshold temperature.

The short circuit protection circuit 220 is coupled to the unregulated input voltage $V_{in}$, the error amplifier 250, and the ground terminal of the LDO regulator 200. In an embodiment, the short circuit protection circuit 220 protects the LDO regulator 200 and prevents rapid discharge of the battery (the unregulated voltage source providing the unregulated input voltage $V_{in}$) by limiting the range of output current $I_{out}$ that can be supplied by the LDO regulator 200.

The voltage reference circuit 230 is coupled to the non-inverting input terminal $IN_+$ of the error amplifier 250, the output terminal 260 of the LDO regulator 200, and the ground terminal of the LDO regulator 200. In an embodiment, the voltage reference circuit 230 comprises a bandgap reference circuit which provides (to the noninverting input terminal $IN_+$ of the error amplifier 250) a stable reference voltage that varies insubstantially over a broad temperature range. In an embodiment, the voltage reference circuit 230 supplies a 1.25 Volts reference voltage. It should be understood that the reference voltage can have other values.

The first feedback resistor R1 and the second feedback resistor R2 are coupled in series between the output terminal 260 of the LDO regulator 260 and the ground terminal of the LDO regulator 260. Moreover, the first feedback resistor R1 and the second feedback resistor R2 generate a feedback voltage at Node F. The feedback voltage at Node F is coupled to the inverting input terminal $IN_-$ of the error amplifier 250. In an embodiment, the first feedback resistor R1 has a value of 65 kiloOhms while the second feedback resistor R2 has a value of 52 kiloOhms. It should be understood that the first feedback resistor R1 and the second feedback resistor R2 can have other values.

The error amplifier 250 is coupled to the unregulated input voltage $V_{in}$, the enable circuit 210, the thermal protection circuit 215, the short circuit protection circuit 220, the voltage reference circuit 230, the Node F, the output terminal 260 of the LDO regulator, and the ground terminal of the LDO regulator 200. In an embodiment, the error amplifier 250 utilizes the reference voltage from the voltage reference circuit 230 and the feedback voltage from Node F to generate and to maintain the regulated output voltage $V_{out}$ at its output terminal 270 which is coupled to the output terminal 260 of the LDO regulator 200. Moreover, the error amplifier 250 supplies the output current $I_{out}$ to the output terminal 260 of the LDO regulator 200. In an embodiment, the error amplifier 250 includes an amplifying stage, a buffer stage, and a pass device stage. The pass device stage is coupled to the unregulated input voltage $V_{in}$ and to the output terminal 270 of the error amplifier 250 so that to provide the output current $I_{out}$. The pass device stage comprises a power p-channel MOSFET (PMOS). In an alternate embodiment, the pass device stage comprises a power PNP transistor. The pass device stage can comprise a physically large transistor capable of driving a large current. Alternatively, the pass device stage can comprise a plurality of physically small transistors (each capable of driving a small current) coupled in parallel to form a physically large transistor capable of driving a large current.

As described above, the load has a load resistance $R_{load}$ which varies widely from application to application and even within a particular application. For example, the load resistance $R_{load}$ can vary approximately from several Ohms (e.g., 35 Ohms) to the resistance associated with an open circuit.

In practice, the LDO regulator 200 is coupled to a circuit board (not shown) such as a printed circuit board (PCB). On the PCB, an output capacitor $C_{output}$ (or load capacitor) is coupled to the output terminal 260 of the LDO regulator 200. The output capacitor $C_{output}$ improves the transient response of the LDO regulator 200, providing a faster transient response. Moreover, the output capacitor $C_{output}$ includes an Equivalent Series Resistance (ESR) to account for the parasitic elements inside the output capacitor $C_{output}$. The ESR is coupled in series with the output capacitor $C_{output}$.

As described above, the PMOS (or PNP transistor) implemented as the pass device in the error amplifier 250 adds a low-frequency pole to the transfer function which provides the frequency response of the LDO regulator 200. The $\text{Frequency}_{pole\ A}$ of this low-frequency pole is dependent on the load resistance $R_{load}$ and the output capacitor $C_{output}$. In particular, the $\text{Frequency}_{pole\ A}$ of the low-frequency pole is approximately described by the equation:

$$\text{Frequency}_{pole\ A}=1/[2\ (pi)\ R_{load}\ C_{output}]. \qquad \text{(Eq. 2)}$$

As discussed above, the load resistance $R_{load}$ varies widely. Hence, the low-frequency pole has a variable frequency. An increase in the load resistance $R_{load}$ causes a decrease in the $\text{Frequency}_{pole\ A}$ of the low-frequency pole. Moreover, a decrease in the load resistance $R_{load}$ causes an increase in the $\text{Frequency}_{pole\ A}$ of the low-frequency pole.

Generally, the LDO regulator 200 is stable and does not oscillate if when the gain response=1 at the unity gain frequency, the phase response is greater than −180 degrees (e.g., −100, −133, −160, etc.) to avoid positive feedback and oscillation. Similarly, the LDO regulator 200 is stable and does not oscillate if when the phase response=−180 degrees at a particular frequency, the gain response is less than 1 at the particular frequency. Moreover, the phase margin (the amount of phase that is greater than −180 degrees at a certain frequency) determines the transient response of the LDO regulator 200. If the phase margin is positive and is greater than a few degrees, the LDO regulator 200 is generally stable and has a transient response with reduced ringing and less parasitic excitations. If the phase margin is negative, the LDO regulator is generally unstable and oscillates. The low-frequency pole negatively impacts the frequency response of the LDO regulator 200. Generally, the $\text{Frequency}_{pole\ A}$ of the low-frequency pole is lower than the unity gain frequency of the LDO regulator 200. Thus, near the $\text{Frequency}_{pole\ A}$ of the low-frequency pole, a phase shift of −45 degrees occurs, and for frequencies higher than the $\text{Frequency}_{pole\ A}$ of the low-frequency pole, this phase shift approaches −90 degrees, significantly degrading the phase margin of the LDO regulator 200 prior to incorporating the frequency compensation technique of the present invention.

In the frequency compensation scheme of the prior art, the output capacitor $C_{output}$ and the ESR (having a minimum value and a maximum value) of the output capacitor $C_{output}$ introduced a low-frequency zero to improve the phase margin of the LDO regulator 200 prior to incorporating the frequency compensation technique of the present invention. Near the frequency of the low-frequency zero, a phase shift of +45 degrees occurs, and for frequencies higher than the frequency of the low-frequency zero, this phase shift approaches +90 degrees, significantly improving the phase margin of the LDO regulator 200. The frequency of the low-frequency zero is approximately described by the equation:

$$\text{Frequency}=1/[2(pi)(ESR)C_{output}]. \quad \text{(Eq. 3)}$$

According to the prior art, the ESR has a minimum value and a maximum value to ensure the stability of the LDO regulator 200 prior to incorporating the frequency compensation technique of the present invention. Hence, the low-frequency zero has a variable frequency which varies to respond to the variation in the $\text{Frequency}_{pole\ A}$ of the low-frequency pole (see Eq. 2). An increase in the ESR causes a decrease in the frequency of the low-frequency zero. Moreover, a decrease in the ESR causes an increase in the frequency of the low-frequency zero. As discussed above, the range of values for the ESR required for a specified value of the output capacitor $C_{output}$ prohibits the use of ceramic capacitors as the output capacitor $C_{output}$ because ceramic capacitors generally have a minimum value and a maximum value for the ESR that are smaller than the required range of values for the ESR to ensure the stability of the LDO regulator 200 prior to incorporating the frequency compensation technique of the present invention.

In the frequency compensation technique of the present invention, circuitry is incorporated into the error amplifier 250 to provide an adaptive zero to the frequency response of the LDO regulator 200 to maintain stability and to improve transient response, rather than depending on the output capacitor $C_{output}$ and its ESR to maintain the stability of the LDO regulator 200. In particular, the frequency of the adaptive zero varies with the output current $I_{out}$ (which inversely varies with the load resistance $R_{load}$ (see Eq. 1)) so that the frequency of the adaptive zero changes (e.g., increases or decreases) in response to changes (e.g., an increase or a decrease) in the $\text{Frequency}_{pole\ A}$ of the low-frequency pole due to variation in the load resistance $R_{load}$. If the $\text{Frequency}_{pole\ A}$ of the low-frequency pole decreases, the frequency of the adaptive zero decreases to improve the phase margin of the LDO regulator 200. Moreover, if the $\text{Frequency}_{pole\ A}$ of the low-frequency pole increases, the frequency of the adaptive zero increases to improve the phase margin of the LDO regulator 200.

Hence, in an embodiment of the present invention, the ESR of the output capacitor $C_{output}$ is no longer critical for maintaining the stability of the LDO regulator 200. The stability of the LDO regulator 200 becomes minimally dependent on the ESR. Therefore, a broad range of capacitor types can be implemented as the output capacitor $C_{output}$, including a ceramic capacitor. The ceramic capacitor has a small size, requires a minimal amount of space on a printed circuit board, and is significantly less expensive than other capacitor types, such as an electrolytic capacitor or a tantalum capacitor. Moreover, the ceramic capacitor has a small ESR (e.g., generally less than 1 Ohm) compared to the ESR of an electrolytic capacitor or a tantalum capacitor. The transient response of the LDO regulator 200 is improved by using an output capacitor $C_{output}$ having a small ESR. In an embodiment, the output capacitor $C_{output}$ is a ceramic capacitor having a value of approximately 470 nanofarads.

Figure 3:
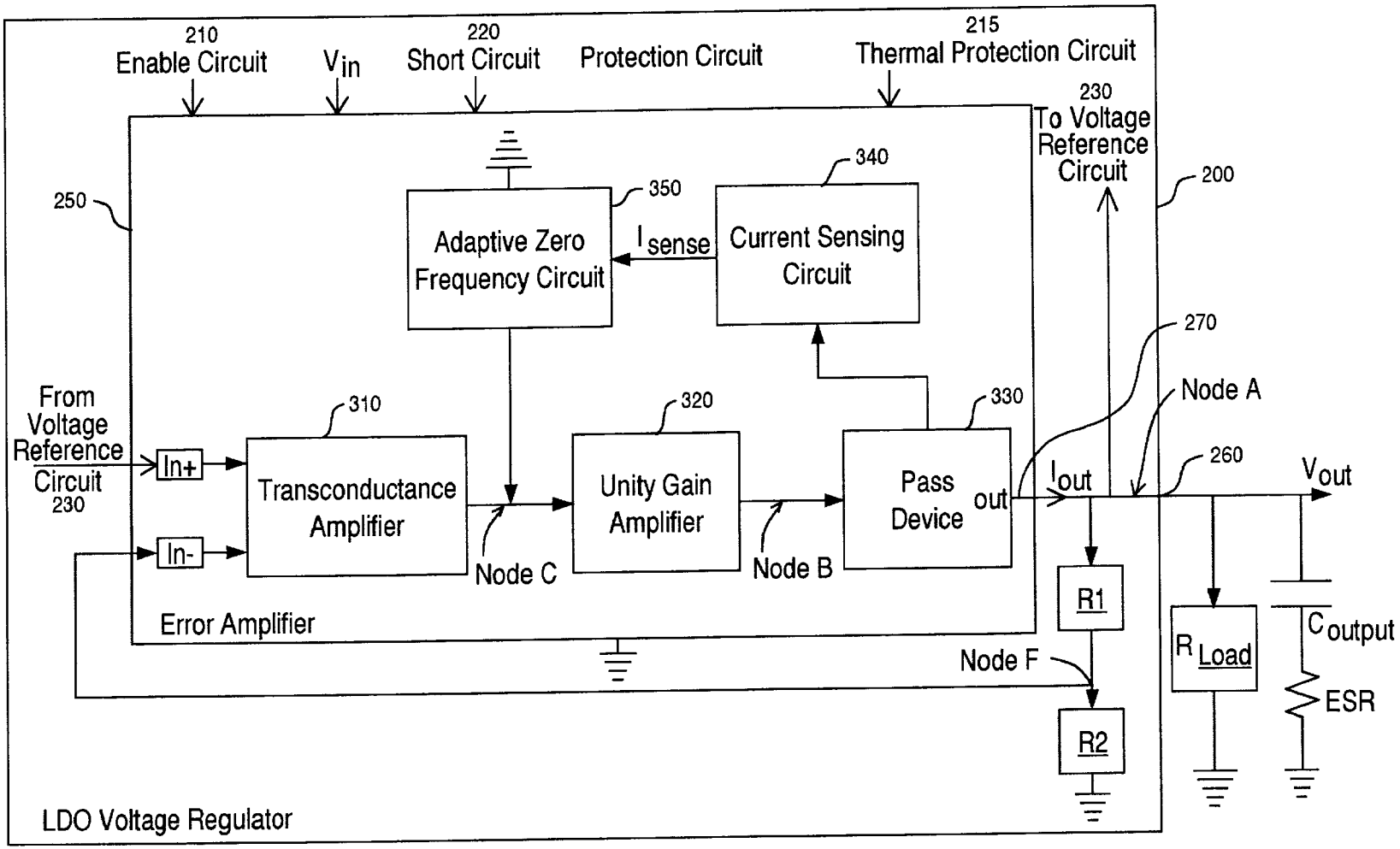
FIG. 3 illustrates a block diagram of an error amplifier of the LDO regulator of FIG. 2.

FIG. 3 illustrates a block diagram of an error amplifier 250 of the LDO regulator 200 of FIG. 2. As illustrated in FIG. 3, the error amplifier 250 is coupled to the unregulated input voltage $V_{in}$, the enable circuit 210, the thermal protection circuit 215, the short circuit protection circuit 220, the voltage reference circuit 230, the Node F, the output terminal 260 of the LDO regulator 200, and the ground terminal of the LDO regulator 200. In particular, the noninverting input terminal $IN_+$ of the error amplifier 250 is coupled to the voltage reference circuit 230. Moreover, the inverting input terminal $IN_-$ of the error amplifier 250 is coupled to the Node F. In addition, the output terminal 270 of the error amplifier 250 is coupled to the output terminal 260 of the LDO regulator 200.

In an embodiment, the error amplifier 250 includes a transconductance amplifier 310 (the amplifying stage), a unity gain amplifier 320 (the buffer stage), and a pass device 330 (the pass device stage). The error amplifier 250 further includes circuitry that implements the frequency compensation scheme of the present invention. In particular, the error amplifier 250 has a current sensing circuit 340 and an adaptive zero frequency circuit 350. It should be understood that the error amplifier 250 can be configured in numerous other configurations. In an embodiment, the error amplifier 250 is comprised of integrated circuits formed with BiCMOS technology components.

The output terminal of the transconductance amplifier 310 is coupled to the unity gain amplifier 320 and to the adaptive zero frequency circuit 350. Moreover, the noninverting input terminal $IN_+$ of the error amplifier 250 is an input to the transconductance amplifier 310. Also, the inverting input terminal $IN_-$ of the error amplifier 250 is an input to the transconductance amplifier 310. The transconductance amplifier 310 has a high open-loop gain, a high input resistance, and a high output resistance. The gain of the LDO regulator 200 is mainly set by the gain of the transconductance amplifier 310.

The unity gain amplifier 320 is coupled to the transconductance amplifier 310, the adaptive zero frequency circuit 350, and the pass device 330. The unity gain amplifier 320 has a high input resistance and a low output resistance. Moreover, the unity gain amplifier 320 isolates the high output resistance of the transconductance amplifier 310 from the high input capacitance of the pass device 330, moving a pole of the LDO regulator 200 from a low frequency to a high frequency.

The pass device 330 is coupled to the unity gain amplifier 320, the current sensing circuit 340, and the output terminal 270 of the error amplifier 250. The pass device 330 supplies the output current $I_{out}$ to the output terminal 270 of the error amplifier 250 and to the output terminal 260 of the LDO regulator 200. In an embodiment, the pass device 330 comprises a power p-channel MOSFET (PMOS) coupled in the common-source configuration. In an alternate embodiment, the pass device 330 comprises a power PNP transistor coupled in the common-emitter configuration. The pass device 330 can comprise a physically large transistor capable of driving a large current. Alternatively, the pass device 330 can comprise a plurality of physically small transistors (each capable of driving a small current) coupled in parallel to form a physically large transistor capable of driving a large current. In an embodiment, the pass device 330 is a power PMOS having a gate width (w) of approximately 12 millimeters.

The current sensing circuit 340 is coupled to the pass device 330 and to the adaptive zero frequency circuit 350. In an embodiment, the current sensing circuit 340 generates a sense current $I_{sense}$ that varies with the output current $I_{out}$ generated by the pass device 330. The adaptive zero frequency circuit 350 receives the sense current $I_{sense}$.

The adaptive zero frequency circuit 350 is coupled to the current sensing circuit 340, the output terminal of the transconductance amplifier 310, the unity gain amplifier 320, and the ground terminal of the LDO regulator 200. In an embodiment, the adaptive zero frequency circuit 350 generates an adaptive zero in the transfer function which provides the frequency response of the LDO regulator 200. The adaptive zero has a $\text{Frequency}_{zero}$ that varies with the sense current $I_{sense}$ so that to maintain the stability of the LDO regulator 200 and to improve the transient response of the LDO regulator 200 under a range of values for the output current $I_{out}$ which varies due to variations in the load resistance $R_{load}$. As described above, the $\text{Frequency}_{pole\ A}$ of the low-frequency pole (see Eq. 2) varies. Therefore, the $\text{Frequency}_{zero}$ of the adaptive zero also varies to improve the phase margin of the LDO regulator 200.

Referring again to FIG. 3, the transfer function of the LDO regulator 200 is substantially characterized by the resistances and capacitances present at Node A (which includes the output terminal 270 of the error amplifier 250 and the output terminal 260 of the LDO regulator 200), Node B (formed by coupling the unity gain amplifier 320 and the pass device 330), and Node C (formed by coupling the transconductance amplifier 310, the unity gain amplifier 320, and the adaptive zero frequency circuit 350). Other poles and zeros are present but they are located order(s) of magnitude above the unity gain frequency of the LDO regulator 200.

The pole at Node A is due to the load resistance $R_{load}$ and the output capacitor $C_{output}$, and has the $\text{Frequency}_{pole\ A}$ described approximately by the Eq. 2 above.

The pole at Node B due to the low output resistance of the unity gain amplifier 320 and the capacitance at Node B. In an embodiment, the capacitance at Node B is primarily the gate capacitance of the power PMOS transistor of the pass device 330. In an embodiment, the low output resistance of the unity gain amplifier 320 causes the frequency of the pole at Node B to be at least an order of magnitude higher than the maximum value of the $\text{Frequency}_{pole\ A}$ of the pole at Node A.

The pole at Node C is due to the resistances and the capacitances at Node C. Moreover, the adaptive zero generated by the adaptive zero frequency circuit 350 has a $\text{Frequency}_{zero}$, which now serves to maintain the stability of the LDO regulator 200, previously achieved in the prior art by the zero associated with the output capacitor $C_{output}$ and its ESR (see Eq. 3).

Figure 4:
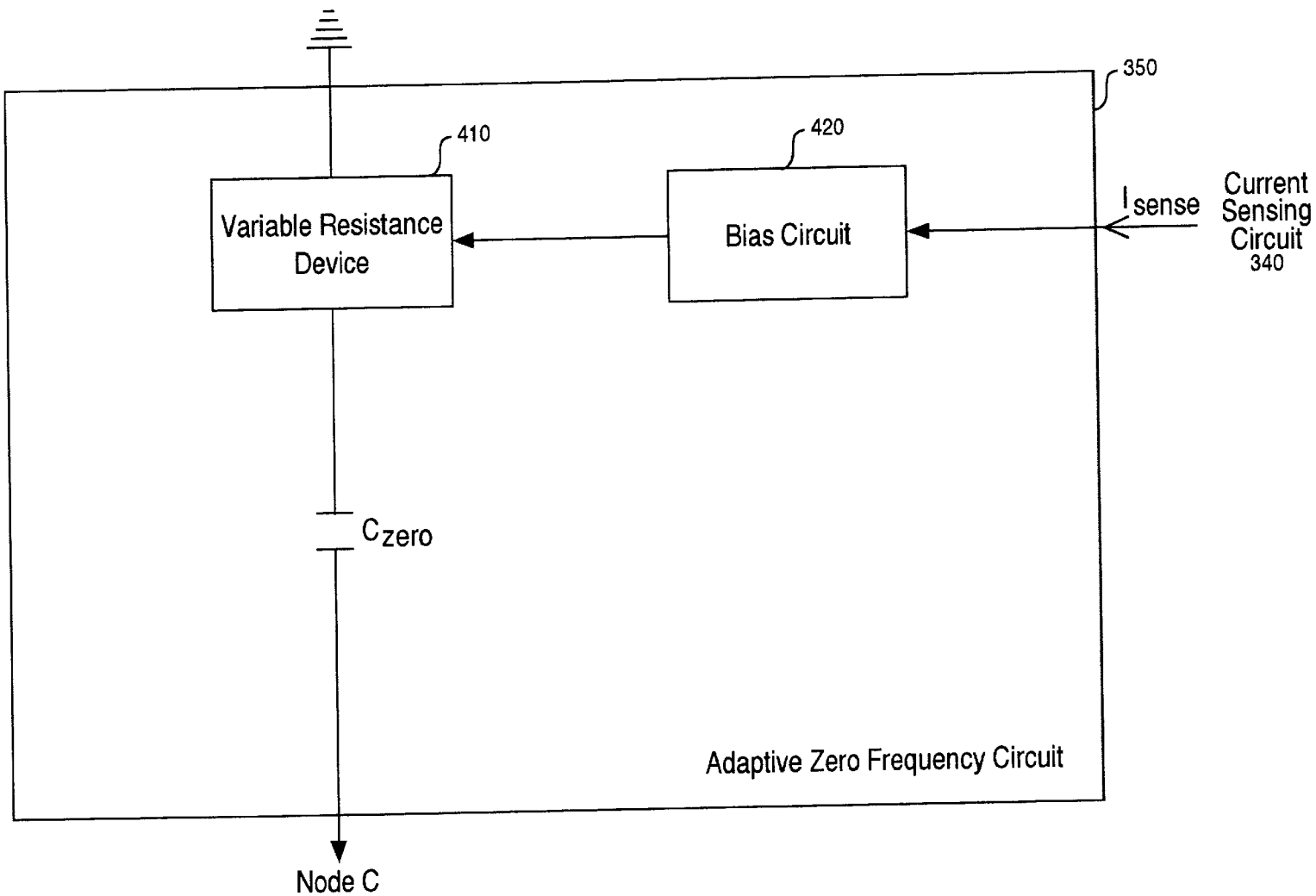
FIG. 4 illustrates a block diagram of an adaptive zero frequency circuit according to an embodiment of the present invention.

FIG. 4 illustrates a block diagram of an adaptive zero frequency circuit 350 according to an embodiment of the present invention. The adaptive zero frequency circuit 350 includes a bias circuit 420, a variable resistance device 410, and a compensation capacitor $C_{zero}$.

The bias circuit 420 is coupled to the current sensing circuit 340 and to the variable resistance device 410. In an embodiment, the bias circuit 420 receives the sense current $I_{sense}$ from the current sensing circuit 340. In response to the sense current $I_{sense}$, the bias circuit 420 appropriately biases the variable resistance device 410.

The variable resistance device 410 is coupled to the bias circuit 420, the compensation capacitor $C_{zero}$, and the ground terminal of the LDO regulator 200. In an embodiment, the variable resistance device 410 has a resistance that inversely varies with a bias parameter generated by the bias circuit 420. If the bias parameter is increased, the resistance of the variable resistance device 410 decreases. If the bias parameter is decreased, the resistance of the variable resistance device 410 increases. In particular, the resistance of the variable resistance device 410 inversely varies with the sense current $I_{sense}$ received by the bias circuit 420. Thus, the resistance of the variable resistance device 410 also inversely varies with the output current $I_{out}$. In an embodiment, the variable resistance device 410 comprises a MOSFET operated (or biased) in the linear region (or triode region). The resistance $R_{DS}$ (measured between the drain and the source of the MOSFET) in the linear region is a function of the geometric dimensions gate width (W), gate length (L), and the gate-source voltage $V_{GS}$ (or bias parameter) applied to the MOSFET by the bias circuit 420. Large values for the resistance $R_{DS}$ can be attained in a relatively small integrated circuit area on a semiconductor chip by proper selection of the W, L, and the gate-source voltage $V_{GS}$ applied to the MOSFET.

Continuing with FIG. 4, the compensation capacitor $C_{zero}$ is coupled to the variable resistance device 410 and Node C (see FIG. 3). In an embodiment, the compensation capacitor $C_{zero}$ comprises an integrated circuit capacitor. The integrated circuit capacitor can be formed using bipolar integrated circuit technology, MOSFET integrated circuit technology, or any other type of integrated circuit technology. In an embodiment, the compensation capacitor $C_{zero}$ is an integrated circuit capacitor having a value of approximately 5 picofarads. The resistance $R_{DS}$ of the variable resistance device 410 in series with the compensation capacitor $C_{zero}$ form the adaptive zero to improve the phase margin of the LDO regulator 200 so that to maintain the stability of the LDO regulator 200 and to improve the transient response of the LDO regulator 200 under a range of values for the output current $I_{out}$ which varies due to variations in the load resistance $R_{load}$. The adaptive zero has the $\text{Frequency}_{zero}$ which is approximately described by the equation:

$$\text{Frequency}_{zero}=1/[2(pi)R_{DS}\ C_{zero}]. \qquad \text{(Eq. 4)}$$

In an embodiment, the $\text{Frequency}_{zero}$ of the adaptive zero varies due to variation in the resistance $R_{DS}$ (of the variable resistance device 410) caused by variation in the output current $I_{out}$. The variation in the resistance $R_{DS}$ is designed to vary the $\text{Frequency}_{zero}$ of the adaptive zero so that to improve the phase margin of the LDO regulator 200 since the pole at Node A (at the $\text{Frequency}_{pole\ A}$) degrades the phase margin in a range of frequencies lower than the unity gain frequency of the LDO regulator 200. Eq. 1, Eq. 2, Eq. 4, and the fact that the resistance $R_{DS}$ of the variable resistance device 410 inversely varies with the output current $I_{out}$ show that both the $\text{Frequency}_{pole\ A}$ and the $\text{Frequency}_{zero}$ move in parallel (e.g., both increase or both decrease) under a range of values for the output current $I_{out}$ which varies due to variations in the load resistance $R_{load}$. In an embodiment, the resistance $R_{DS}$ can range approximately from 100 kiloOhms to 800 kiloOhms. It should be understood that the resistance $R_{DS}$ can have other values.

Figure 5:
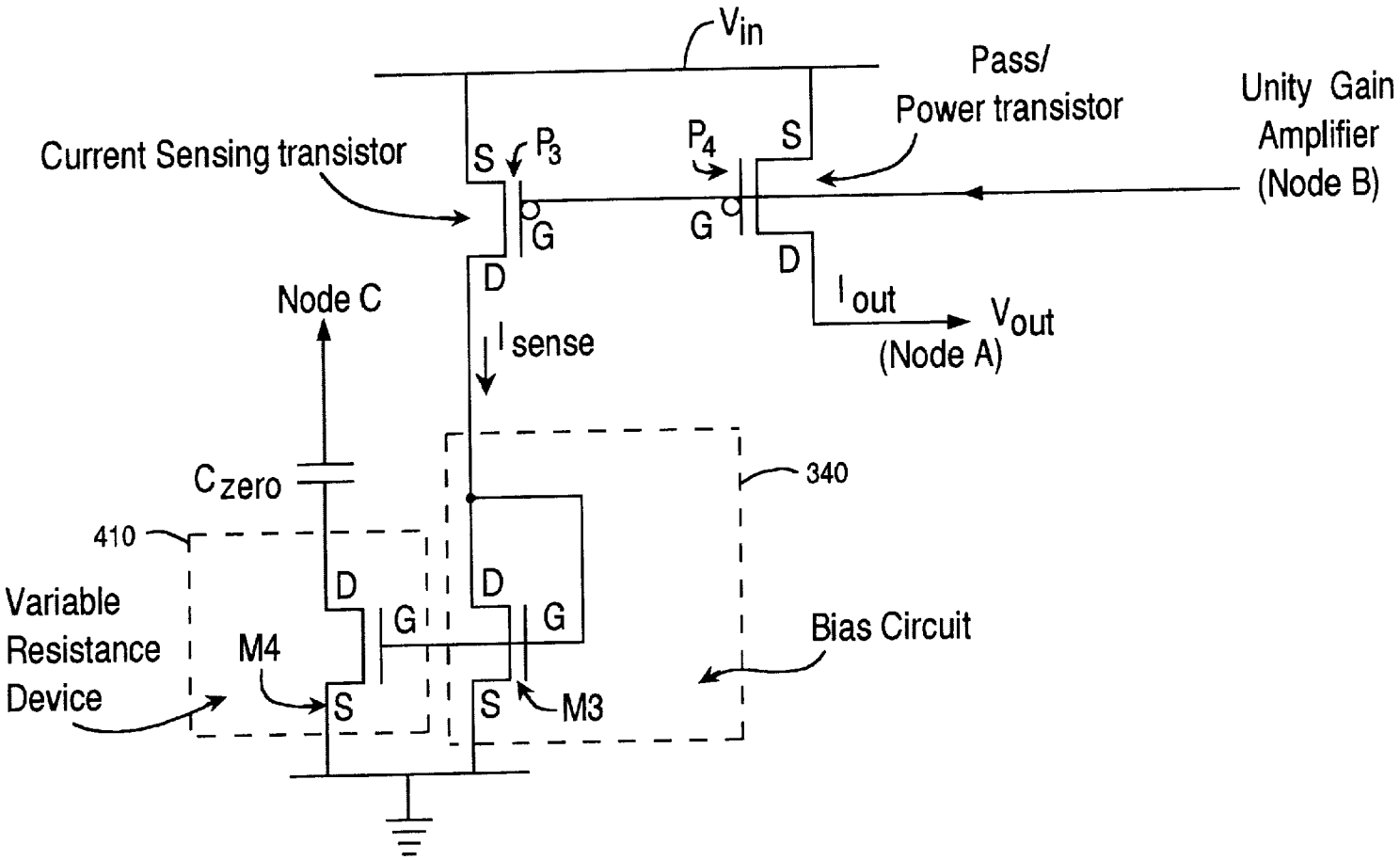
FIG. 5 illustrates a circuit schematic of the adaptive zero frequency circuit of FIG. 4.

FIG. 5 illustrates a circuit schematic of the adaptive zero frequency circuit 350 of FIG. 4 and FIG. 3. As illustrated in FIG. 5, the pass device 330 comprises a power p-type channel MOSFET (transistor P4). The current sensing circuit 340 comprises a p-type channel MOSFET (transistor P3) having a gate width W. In an alternate embodiment, the current sensing circuit 340 comprises a plurality of p-type channel MOSFETs (each having a gate width that is larger than the gate width W) coupled in series between the unregulated input voltage $V_{in}$ and the bias circuit 340, whereas each gate of the plurality of p-type channel MOSFETs is coupled to the gate of the transistor P4, thus providing the sense current $I_{sense}$ to the bias circuit 340 within a shorter time period in response to the output current $I_{out}$ generated by the transistor P4.

The source of transistor P4 is coupled to the unregulated input voltage $V_{In}$. The gate of transistor P4 is coupled to the unity gain amplifier 320 to form the Node B. The drain of transistor P4 is coupled to Node A (which includes the output terminal 270 of the error amplifier 250 and the output terminal 260 of the LDO regulator 200) and provides the regulated output voltage $V_{out}$ and the output current $I_{out}$.

The source of transistor P3 is coupled to the unregulated input voltage $V_{in}$. The gate of transistor P3 is coupled to the gate of transistor P4 . The drain of transistor P3 is coupled to the bias circuit 340 and provides the sense current $I_{sense}$.

In an embodiment, the gate length (L4) of transistor P4 and the gate length (L3) of transistor P3 are equivalent so that the sense current $I_{sense}$ accurately represents the amount of output current $I_{out}$. Moreover, the ratio of the gate width (W4) of transistor P4 to the gate width (W3) of transistor P3 is N. The sense current $I_{sense}$ is approximately described by the equation:

$$I_{sense}=I_{out}/N. \quad \text{(Eq. 5)}$$

In an embodiment, the ratio N (i.e., W4/W3) is approximately 8000. W3 and W4 can have a variety of values. For example, W3 can be approximately 1.5 micrometers and W4 can be approximately 12 millimeters. It should be understood that the ratio N, W4, and W3 can have any other values.

In an embodiment, the bias circuit 340 comprises a n-type channel MOSFET (transistor M3). The source of transistor M3 is coupled to the ground terminal of the LDO regulator 200. The gate of transistor M3 is coupled to the drain of transistor M3. Also, the gate of transistor M3 is coupled to the variable resistance device 410. The drain of transistor M3 is coupled to the drain of transistor P3 and receives the sense current $I_{sense}$ from the transistor P3. The transistor M3 is operated in the saturation region. Moreover, the transistor M3 biases the variable resistance device 410 in the linear region according to the sense current $I_{sense}$ received from the transistor P3. The gate-source voltage $V_{GS}$ of transistor M3 is utilized to bias the variable resistance device 410. The gate-source voltage $V_{GS}$ of transistor M3 varies with the sense current $I_{sense}$. If the sense current $I_{sense}$ increases, the gate-source voltage $V_{GS}$ of transistor M3 increases. If the sense current $I_{sense}$ decreases, the gate-source voltage $V_{GS}$ of transistor M3 decreases. As described above, the sense current $I_{sense}$ varies with the output current $I_{out}$.

In an embodiment, the variable resistance device 410 comprises a n-type channel MOSFET (transistor M4). The source of transistor M4 is coupled to the ground terminal of the LDO regulator 200. The gate of transistor M4 is coupled to the gate of transistor M3 such that transistor M4 is biased by the gate-source voltage $V_{GS}$ of transistor M3. It should be understood that a positive gate-source voltage $V_{GS}$ is applied to a n-type channel MOSFET in order to turn it on. The drain of transistor M4 is coupled to the compensation capacitor $C_{zero}$. The transistor M4 is operated in the linear region. The resistance $R_{DS}$ (measured between the drain and the source of the transistor M4) in the linear region is a function of the geometric dimensions gate width (W1) and gate length (L1) of the transistor M4, and the gate-source voltage $V_{GS}$ (or bias parameter) applied to the transistor M4 by the transistor M3, whereas the gate-source voltage $V_{GS}$ is a function of the geometric dimensions gate width (W2) and gate length (L2) of the transistor M3 and the output current $I_{out}$. In particular, the resistance $R_{DS}$ varies with L1, inversely varies with W1, and inversely varies with the gate-source voltage $V_{GS}$.

The compensation capacitor $C_{zero}$ is coupled to the drain of transistor M4, to the output terminal of the transconductance amplifier 310, and to the unity gain amplifier 320 (which form Node C as illustrated in FIG. 3). The resistance $R_{DS}$ of the transistor M4 in series with the compensation capacitor $C_{zero}$ form the adaptive zero to Improve the phase margin of the LDO regulator 200 so that to maintain the stability of the LDO regulator 200 and to improve the transient response of the LDO regulator 200 under a range of values for the output current $I_{out}$ which varies due to variations in the load resistance $R_{load}$. The adaptive zero has the $\text{Frequency}_{zero}$ which is approximately described by the Eq. 4 above.

During operation of the LDO regulator 200, the unity gain amplifier 320 supplies a driving voltage to the gate of transistor P4, generating a gate-source voltage in transistor P4. Thus, the transistor P4 is turned on, generating the output current $I_{out}$ at the drain of transistor P4 and providing the regulated output voltage $V_{out}$. The output current $I_{out}$ varies with the magnitude of the gate-source voltage applied to the transistor P4. Generally, the output current $I_{out}$ increases when the magnitude of the gate-source voltage applied to the transistor P4 is increased. Moreover, the output current $I_{out}$ decreases when the magnitude of the gate-source voltage applied to the transistor P4 is decreased. In an embodiment, the LDO regulator 200 generates a regulated output voltage $V_{out}$ having the approximate value 2.8 volts while the output current $I_{out}$ can range approximately from 0 Amps to 80 milliamps. It should be understood that regulated output voltage $V_{out}$ and the output current $I_{out}$ can have other values.

Next, the gate-source voltage applied to the transistor P4 also turns on the transistor P3 since the gate of the transistor P3 is coupled to the gate of the transistor P4. The transistor P3 generates the sense current $I_{sense}$ at the drain of transistor P3, whereas the sense current $I_{sense}$ varies with the output current $I_{out}$ (see Eq. 5). As described in Eq. 5 above, the sense current $I_{sense}$ is substantially smaller than the output current $I_{out}$. In an embodiment, the sense current $I_{sense}$ can range approximately from 0 Amps to 10 microamps. It should be understood that the sense current $I_{sense}$ can have other values.

Furthermore, the sense current $I_{sense}$ is received by the transistor M3, changing the gate-source voltage $V_{GS}$ of transistor M3. The gate-source voltage $V_{GS}$ of transistor M3 varies with the sense current $I_{sense}$. Then, the gate-source voltage $V_{GS}$ of transistor M3 is applied to the transistor M4 via the gate of the transistor M4 coupled to the gate of the transistor M3, biasing the transistor M4 in the linear region based on the gate-source voltage $V_{GS}$ applied to transistor M4. This biasing operation changes the resistance $R_{DS}$ of the transistor M4 in the linear region. In an embodiment, the resistance $R_{DS}$ of the transistor M4 can range approximately from 100 kiloOhms (corresponding with the output current $I_{out}$ having the approximate value of 80 milliamps) to 800 kiloOhms (corresponding with the output current $I_{out}$ having the approximate value of 0 Amps). It should be understood that the resistance $R_{DS}$ can have other values. Therefore, the resistance $R_{DS}$ of the transistor M4 in series with the compensation capacitor $C_{zero}$ form the adaptive zero to improve the phase margin of the LDO regulator 200 so that to maintain the stability of the LDO regulator 200 and to improve the transient response of the LDO regulator 200 under a range of values for the output current $I_{out}$ which varies due to variations in the load resistance $R_{load}$.

Figure 6:
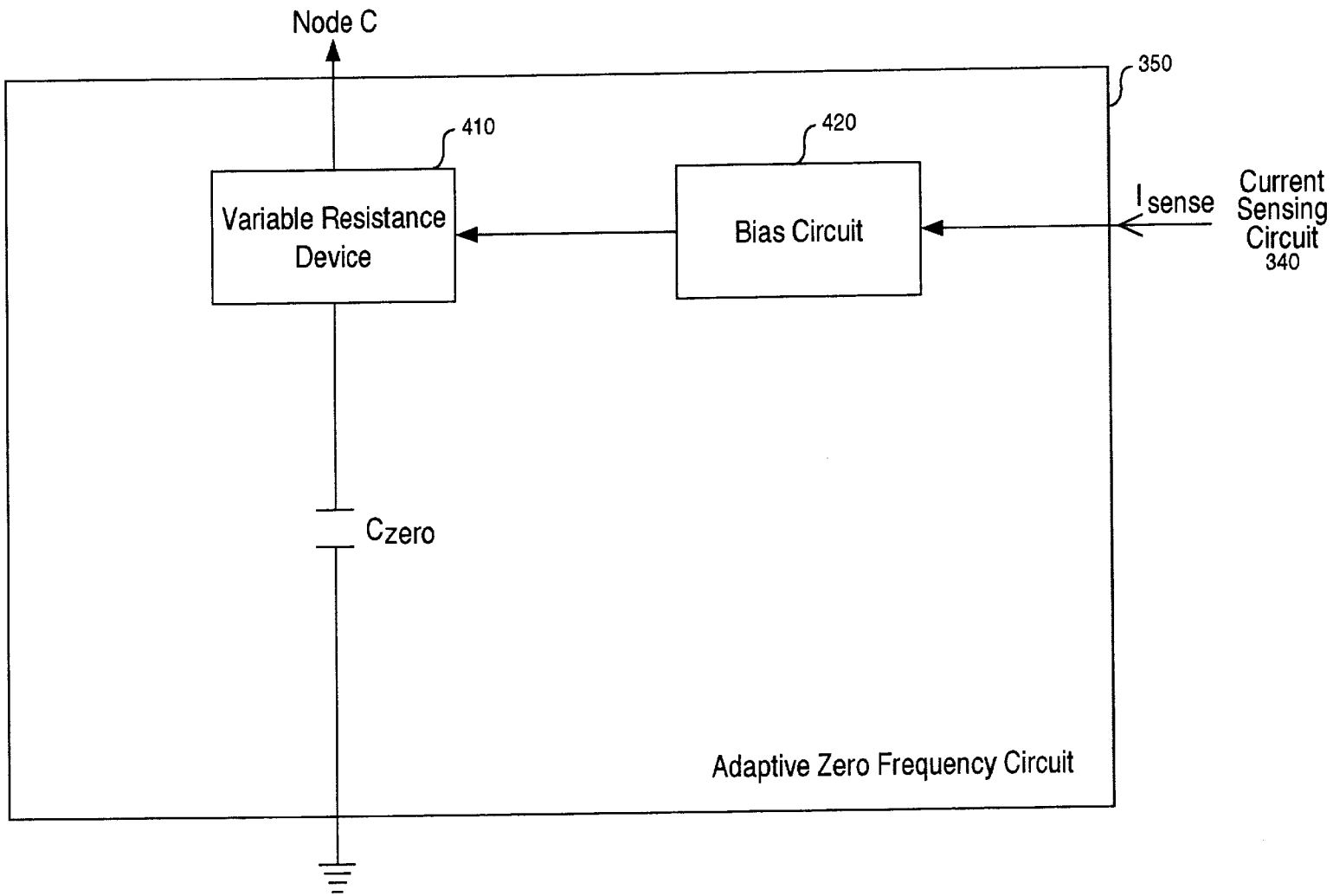
FIG. 6 illustrates a block diagram of an adaptive zero frequency circuit according to a second embodiment of the present invention.

FIG. 6 illustrates a block diagram of an adaptive zero frequency circuit 350 according to a second embodiment of the present invention. The adaptive zero frequency circuit 350 includes a bias circuit 420, a variable resistance device 410, and a compensation capacitor $C_{zero}$.

The bias circuit 420 is coupled to the current sensing circuit 340 and to the variable resistance device 410. In a second embodiment of the present invention, the bias circuit 420 operates and is implemented as discussed with respect to the bias circuit 420 in FIG. 4.

The variable resistance device 410 is coupled to the bias circuit 420, the compensation capacitor $C_{zero}$, and the Node C (see FIG. 3). In a second embodiment of the present invention, the variable resistance device 410 operates and is implemented as discussed with respect to the variable resistance device 410 in FIG. 4.

Continuing with FIG. 6, the compensation capacitor $C_{zero}$ is coupled to the variable resistance device 410 and to the ground terminal of the LDO regulator 200. By coupling the compensation capacitor $C_{zero}$ to the ground terminal of the LDO regulator 200, the parasitic capacitances associated with the compensation capacitor. $C_{zero}$ (e.g., when implemented as an integrated circuit capacitor) are minimized to improve the performance of the LDO regulator 200. In a second embodiment of the present invention, the compensation capacitor $C_{zero}$ operates and is implemented as discussed with respect to the compensation capacitor $C_{zero}$ in FIG. 4. The resistance $R_{DS}$ of the variable resistance device 410 in series with the compensation capacitor $C_{zero}$ form the adaptive zero to improve the phase margin of the LDO regulator 200 so that to maintain the stability of the LDO regulator 200 and to improve the transient response of the LDO regulator 200 under a range of values for the output current $I_{out}$ which varies due to variations in the load resistance $R_{load}$. The adaptive zero has the $\text{Frequency}_{zero}$ which is approximately described by Eq. 4 above. In a second embodiment of the present invention, the resistance $R_{DS}$ can range approximately from 100 kiloOhms to 800 kiloOhms. It should be understood that the resistance $R_{DS}$ can have other values.

Figure 7:
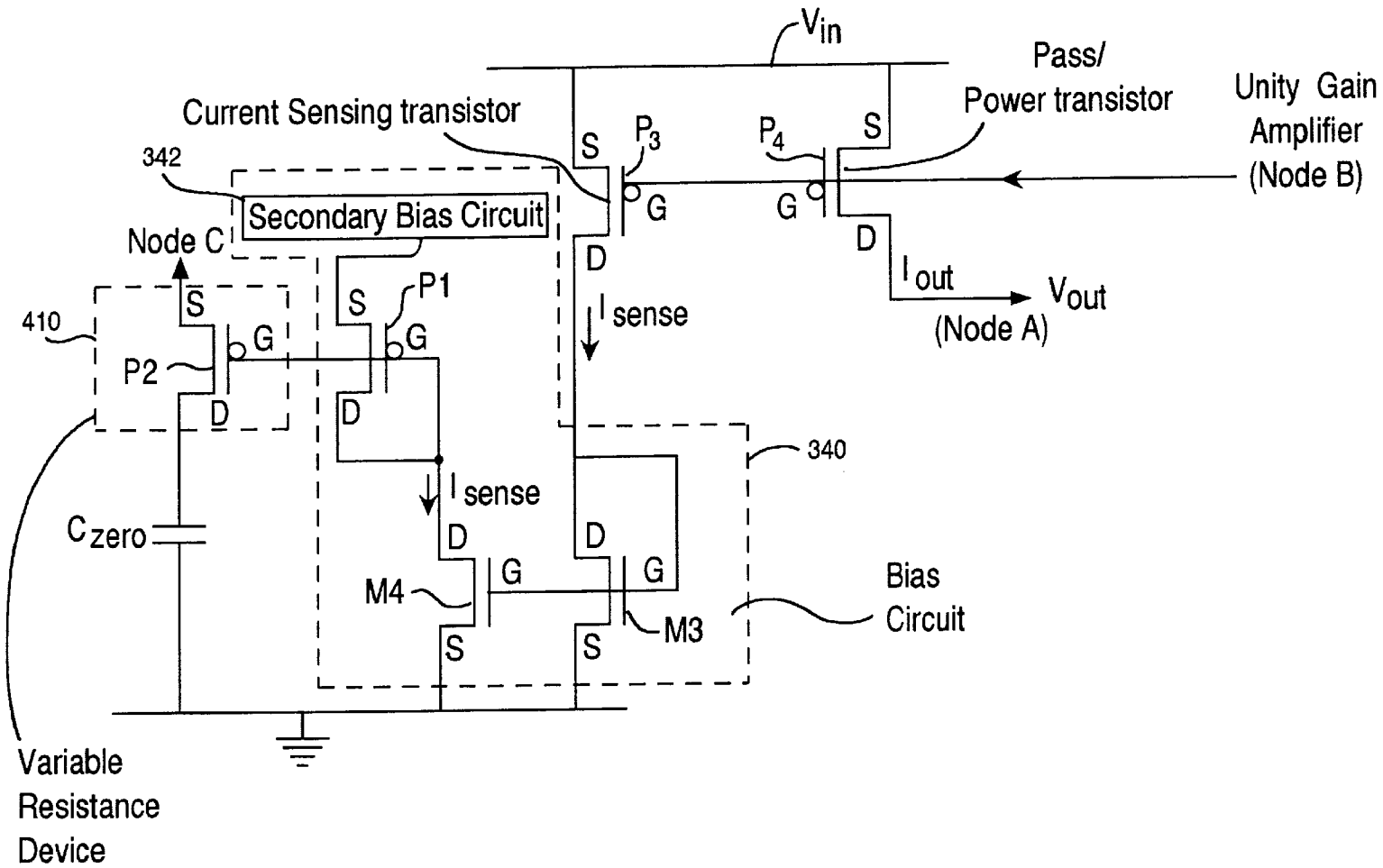
FIG. 7 illustrates a circuit schematic of the adaptive zero frequency circuit of FIG. 6.

FIG. 7 illustrates a circuit schematic of the adaptive zero frequency circuit 350 of FIG. 6 and FIG. 3. As illustrated in FIG. 7, the pass device 330 comprises a power p-type channel MOSFET (transistor P4). The current sensing circuit 340 comprises a p-type channel MOSFET (transistor P3) having a gate width W. In an alternate embodiment, the current sensing circuit 340 comprises a plurality of p-type channel MOSFETs (each having a gate width that is larger than the gate width W) coupled in series between the unregulated input voltage $V_{in}$ and the bias circuit 340, whereas each gate of the plurality of p-type channel MOSFETs is coupled to the gate of the transistor P4, thus providing the sense current $I_{sense}$ to the bias circuit 340 within a shorter time period in response to the output current $C_{out}$ generated by the transistor P4.

The source of transistor P4 is coupled to the unregulated input voltage $V_{in}$. The gate of transistor P4 is coupled to the unity gain amplifier 320 to form the Node B. The drain of transistor P4 is coupled to Node A (which includes the output terminal 270 of the error amplifier 250 and the output terminal 260 of the LDO regulator 200) and provides the regulated output voltage $V_{out}$ and the output current $I_{out}$.

The source of transistor P3 is coupled to the unregulated input voltage $V_{in}$. The gate of transistor P3 is coupled to the gate of transistor P4 . The drain of transistor P3 is coupled to the bias circuit 340 and provides the sense current $I_{sense}$.

In a second embodiment of the present invention, the gate length (L4) of transistor P4 and the gate length (L3) of transistor P3 are equivalent so that the sense current $I_{sense}$ accurately represents the amount of output current $I_{out}$. Moreover, the ratio of the gate width (W4) of transistor P4 to the gate width (W3) of transistor P3 is N. The sense current $I_{sense}$ is approximately described by the Eq. 5 above. In a second embodiment of the present invention, the ratio N (i.e., W4/W3) is approximately 8000. W3 and W4 can have a variety of values. For example, W3 can be approximately 1.5 micrometers and W4 can be approximately 12 millimeters. It should be understood that the ratio N, W4, and W3 can have any other values.

In a second embodiment of the present invention, the bias circuit 340 comprises a first n-type channel MOSFET (transistor M3), a second n-type channel MOSFET (transistor M4), a first p-type channel MOSFET (transistor P1), and a secondary bias circuit 342.

The source of transistor M3 is coupled to the ground terminal of the LDO regulator 200. The gate of transistor M3 is coupled to the drain of transistor M3 . Also, the gate of transistor M3 is coupled to the variable resistance device 410. The drain of transistor M3 is coupled to the drain of transistor P3 and receives the sense current $I_{sense}$ from the transistor P3. The transistor M3 is operated in the saturation region.

Furthermore, the source of transistor M4 is coupled to the ground terminal of the LDO regulator 200. The gate of transistor M4 is coupled to the gate of transistor M3 such that transistor M4 is biased by the gate-source voltage $V_{GS}$ of transistor M3. The drain of transistor M4 is coupled to the drain and the gate of the transistor P1. The transistors M4 and M3 form a current mirror such that the sense current $I_{sense}$ at the drain of transistor M3 is generated at the drain of the transistor M4.

Also, the source of transistor P1 is coupled to the secondary bias circuit 342. In particular, the secondary bias circuit 342 biases the transistor P1 such that the gate-source voltage $V_{GS}$ of the transistor P1 approximates the gate-source voltage of the transistors P3 and P4. The gate of transistor P1 is coupled to the drain of transistor P1 and to the variable resistance device 410. The drain of transistor P1 is coupled to the drain of the transistor M4. The transistor P1 is operated in the saturation region. Moreover, the transistor P1 biases the variable resistance device 410 in the linear region according to the sense current $I_{sense}$ generated by the transistor P3. The gate-source voltage $V_{GS}$ of transistor P1 is utilized to bias the variable resistance device 410. The magnitude of the gate-source voltage $V_{GS}$ of transistor P1 varies with the sense current $I_{sense}$. If the sense current $I_{sense}$ increases, the magnitude of the gate-source voltage $V_{GS}$ of transistor P1 increases. If the sense current $I_{sense}$ decreases, the magnitude of the gate-source voltage $V_{GS}$ of transistor P1 decreases. As described above, the sense current $I_{sense}$ varies with the output current $I_{out}$.

In a second embodiment of the present invention, the variable resistance device 410 comprises a p-type channel MOSFET (transistor P2). The source of transistor P2 is coupled to the output terminal of the transconductance amplifier 310 and to the unity gain amplifier 320 (which form Node C as illustrated in FIG. 3). The gate of transistor P2 is coupled to the gate of transistor P1 such that transistor P2 is biased by the gate-source voltage $V_{GS}$ of transistor P1. It should be understood that a negative gate-source voltage $V_{GS}$ is applied to a p-type channel MOSFET in order to turn it on. The drain of transistor P2 is coupled to the compensation capacitor $C_{zero}$. The transistor P2 is operated in the linear region. The resistance $R_{DS}$ (measured between the drain and the source of the transistor P2) in the linear region is a function of the geometric dimensions gate width (W1) and gate length (L1) of the transistor P2, and the magnitude of the gate-source voltage $V_{GS}$ (or bias parameter) applied to the transistor P2 by the transistor P1, whereas the gate-source voltage $V_{GS}$ is a function of the geometric dimensions gate width (W2) and gate length (L2) of the transistor P1 and the output current $I_{out}$. In particular, the resistance $R_{DS}$ varies with L1, inversely varies with W1, and inversely varies with the magnitude of the gate-source voltage $V_{GS}$.

The compensation capacitor $C_{zero}$ is coupled to the drain of transistor P2 and to the ground terminal of the LDO regulator 200. The resistance $R_{DS}$ of the transistor P2 in series with the compensation capacitor $C_{zero}$ form the adaptive zero to improve the phase margin of the LDO regulator 200 so that to maintain the stability of the LDO regulator 200 and to improve the transient response of the LDO regulator 200 under a range of values for the output current $I_{out}$ which varies due to variations in the load resistance $R_{load}$. The adaptive zero has the $\text{Frequency}_{zero}$ which is approximately described by the Eq. 4 above.

During operation of the LDO regulator 200, the unity gain amplifier 320 supplies a driving voltage to the gate of transistor P4, generating a gate-source voltage in transistor P4. Thus, the transistor P4 is turned on, generating the output current $I_{out}$ at the drain of transistor P4 and providing the regulated output voltage $V_{out}$. The output current $I_{out}$ varies with the magnitude of the gate-source voltage applied to the transistor P4. Generally, the output current $I_{out}$ increases when the magnitude of the gate-source voltage applied to the transistor P4 is increased. Moreover, the output current $I_{out}$ decreases when the magnitude of the gate-source voltage applied to the transistor P4 is decreased. In a second embodiment of the present invention, the LDO regulator 200 generates a regulated output voltage $V_{out}$ having the approximate value 2.8 volts while the output current $I_{out}$ can range approximately from 0 Amps to 80 milliamps. It should be understood that regulated output voltage $V_{out}$ and the output current $I_{out}$ can have other values.

Next, the gate-source voltage applied to the transistor P4 also turns on the transistor P3 since the gate of the transistor P3 is coupled to the gate of the transistor P4. The transistor P3 generates the sense current $I_{sense}$ at the drain of transistor P3, whereas the sense current $I_{sense}$ varies with the output current $I_{out}$ (see Eq. 5). As described in Eq. 5 above, the sense current $I_{sense}$ is substantially smaller than the output current $I_{out}$. In a second embodiment of the present invention, the sense current $I_{sense}$ can range approximately from 0 Amps to 10 microamps. It should be understood that the sense current $I_{sense}$ can have other values.

Furthermore, the sense current $I_{sense}$ is received by the current mirror formed by transistors M3 and M4 such that the sense current $I_{sense}$ at the drain of transistor M3 is generated at the drain of the transistor M4. The sense current $I_{sense}$ changes the gate-source voltage $V_{GS}$ of transistor P1. The magnitude of the gate-source voltage $V_{GS}$ of transistor P1 varies with the sense current $I_{sense}$. Then, the gate-source voltage $V_{GS}$ of transistor P1 is applied to the transistor P2 via the gate of the transistor P2 coupled to the gate of the transistor P1, biasing the transistor P2 in the linear region based on the magnitude of the gate-source voltage $V_{GS}$ applied to transistor P2. This biasing operation changes the resistance $R_{DS}$ of the transistor P2 in the linear region. In a second embodiment of the present invention, the resistance $R_{DS}$ Of the transistor P2 can range approximately from 100 kiloOhms (corresponding with the output current $I_{out}$ having the approximate value of 80 milliamps) to 800 kiloOhms (corresponding with the output current $I_{out}$ having the approximate value of 0 Amps). It should be understood that the resistance $R_{DS}$ can have other values. Therefore, the resistance $R_{DS}$ of the transistor P2 in series with the compensation capacitor $C_{zero}$ form the adaptive zero to improve the phase margin of the LDO regulator 200 so that to maintain the stability of the LDO regulator 200 and to improve the transient response of the LDO regulator 200 under a range of values for the output current $I_{out}$ which varies due to variations in the load resistance $R_{load}$.

Figure 8:
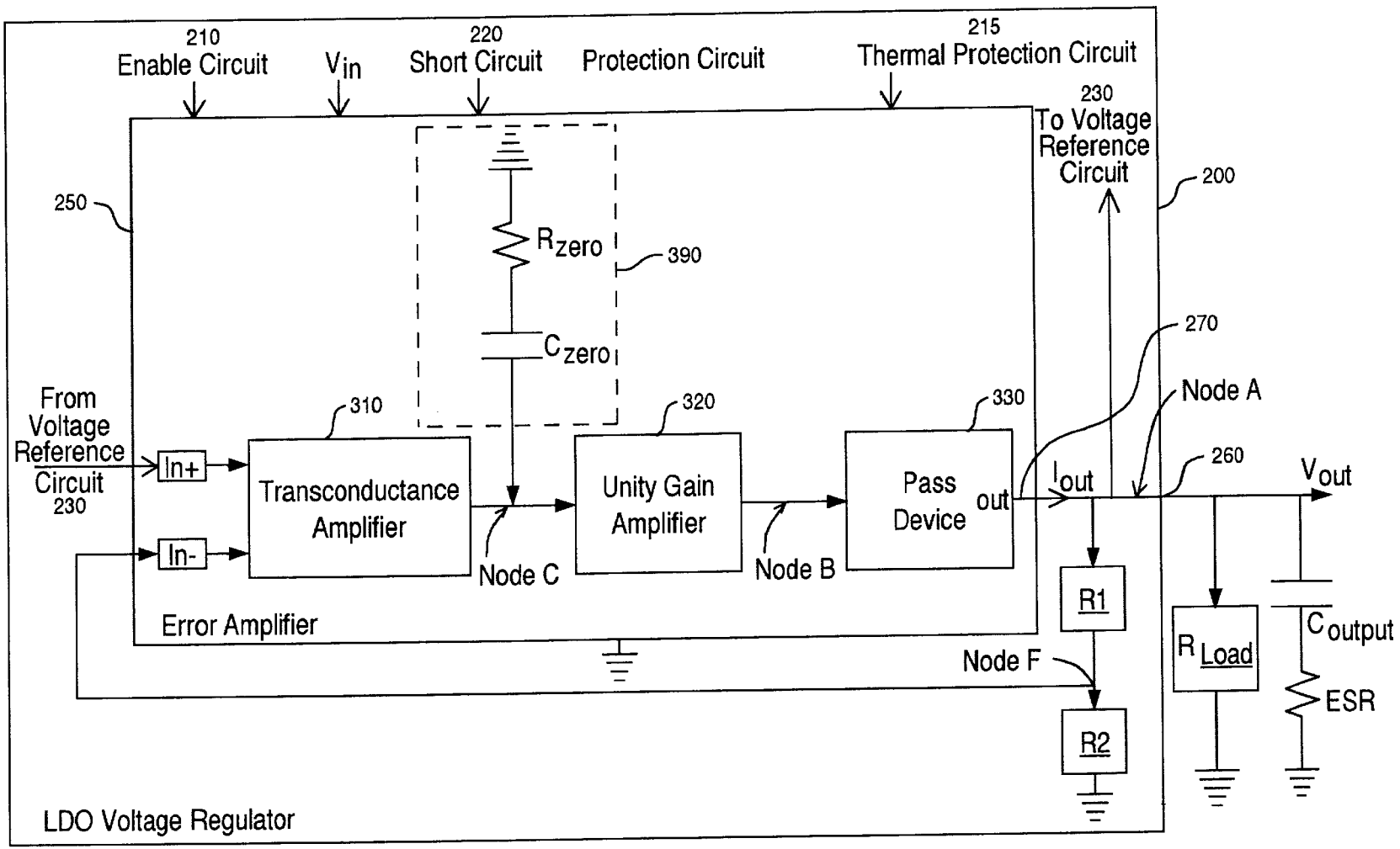
FIG. 8 illustrates a frequency compensation circuit of the prior art in a LDO regulator.

FIG. 8 illustrates a frequency compensation circuit 390 of the prior art in a LDO regulator 200. FIG. 8 shows the LDO regulator 200 of FIG. 3 except that the frequency compensation scheme of the present invention (i.e., the adaptive zero frequency circuit 350 and the current sensing circuit 340) has been remove and replaced by the frequency compensation circuit 390 of the prior art. In particular, the frequency compensation circuit 390 of the prior art comprises a compensation resistor $R_{zero}$ and a compensation capacitor $C_{zero}$ coupled in series between the ground terminal of the LDO regulator 200 and Node C (formed by coupling the transconductance amplifier 310, the unity gain amplifier 320, and the frequency compensation circuit 390). The compensation resistor $R_{zero}$ and the compensation capacitor $C_{zero}$ in series provide a fixed zero having the $\text{Frequency}_{fixed\ zero}$ so that to maintain the stability of the LDO regulator 200 when the load resistance $R_{load}$ has a particular value and does not vary. The $\text{Frequency}_{fixed\ zero}$ is approximately described by the equation:

$$\text{Frequency}_{fixed\ zero}=1/[2(pi)R_{zero}\ C_{zero}]. \quad \text{(Eq. 6)}$$

The frequency compensation circuit 390 of the prior art is suitable for cases when the load resistance $R_{load}$ has a particular value and does not vary. However, as described above, the load resistance $R_{load}$ varies widely from application to application and even within a particular application. Hence, the LDO regulator 200 having the frequency compensation circuit 390 of the prior art eventually becomes unstable and oscillates.

FIGS. 9–14 depict simulations that illustrate the benefits of the frequency compensation scheme of the present invention. In particular, the FIGS. 9, 10, 13A, and 13B show the frequency response and the transient response of a LDO regulator having the frequency compensation circuit 390 of the prior art (see FIG. 8). The FIGS. 11, 12, 14A, and 14B show the frequency response and the transient response of a LDO regulator having the frequency compensation scheme of the present invention (see FIG. 3).

Figure 9:
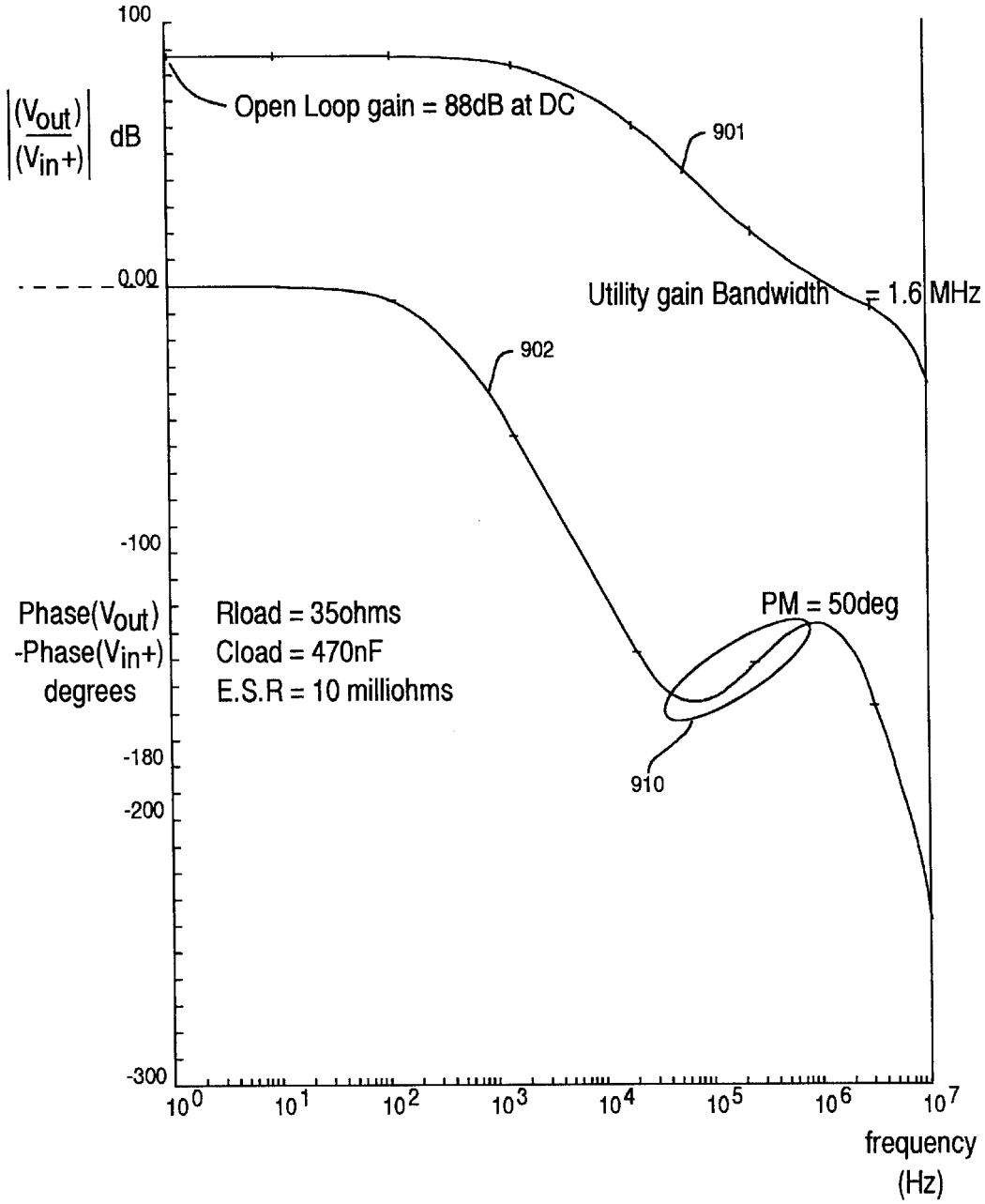
FIG. 9 illustrates a Bode plot of the gain and phase of the frequency response of the LDO regulator of FIG. 8, whereas a small load resistance is coupled to the output of the LDO regulator.

FIG. 9 illustrates a Bode plot of the gain and phase of the frequency response of the LDO regulator of FIG. 8 that includes the frequency compensation circuit 390 of the prior art, whereas a small load resistance $R_{load}$ is coupled to the output terminal of the LDO regulator. The scale from 0 decibel to 100 decibels is utilized to plot the gain (i.e., the curve 901). The scale from 0 degrees to −300 degrees is utilized to plot the phase (i.e., the curve 902). The gain is the open-loop gain of the LDO regulator of FIG. 8, measured in decibels. Referring to FIG. 8, the gain is determined by taking the ratio of the voltage at Node A ($V_{out}$) and the voltage at the noninverting input terminal of the error amplifier 250 ($V_{in+}$), whereas a sinusoidal voltage is applied to the noninverting input terminal of the error amplifier 250.

The phase is the difference between the phase of the voltage at Node A[phase($V_{out}$)] and the phase of the voltage at the noninverting input terminal of the error amplifier 250 [phase($V_{in+}$)].

For the simulation in FIG. 9 (which depicts the frequency response of the LDO regulator 200 of FIG. 8), the load resistance $R_{load}$ is 35 ohms, the output capacitor (or load capacitor) $C_{output}$ is 470 nanofarads and ceramic, and the ESR of the output capacitor $C_{output}$ is 10 milliohms. In addition, the first feedback resistor R1 has a value of 65 kiloOhms while the second feedback resistor R2 has a value of 52 kiloOhms, providing the feedback factor B=0.4444 (or 52000/(65000+52000)). Moreover, the compensation resistor $R_{zero}$ is 100 kiloOhms and the compensation capacitor $C_{zero}$ is 5 picofarads. As shown in FIG. 9, the DC gain A is 25118 or 88 dB. Using the Eq. 2, the $\text{Frequency}_{pole\ A}$ of the pole at Node A is:

$\text{Frequency}_{pole\ A}$=9,675 Hz.

Similarly, using the Eq. 6, the $\text{Frequency}_{fixed\ zero}$ of the fixed zero provided by the frequency compensation circuit 390 of the prior art is:

$\text{Frequency}_{fixed\ zero}$=318,310 Hz.

Also, using the Eq. 3, the Frequency of the zero provided by the output capacitor $C_{output}$ and the ESR is:

Frequency=33,863,000 Hz.

As shown in FIG. 9, the unity gain frequency (i.e., when the gain is 0 dB) is 1.6 megahertz. The Frequency of the zero provided by the output capacitor $C_{output}$ and the ESR is higher than the unity gain frequency. Hence, this zero fails to contribute to the stability of the LDO regulator and does not improve the phase margin of the LDO regulator in the range of frequencies below or near the unity gain frequency. As discussed above, the LDO regulator 200 is stable and does not oscillate if when the gain response=1 at the unity gain frequency, the phase response is greater than −180 degrees (e.g., −100, −130, −150, etc.). Similarly, the LDO regulator 200 is stable and does not oscillate if when the phase response=−180 degrees at a particular frequency, the gain response is less than 1 at the particular frequency. Moreover, the phase margin (the amount of phase that is greater than −180 degrees) determines the transient response of the LDO regulator 200. If the phase margin is positive and is greater than a few degrees, the LDO regulator 200 is generally stable and has a transient response with reduced ringing and less parasitic excitations. If the phase margin is negative, the LDO regulator is generally unstable and oscillates.

As shown in FIG. 9, the $\text{Frequency}_{fixed\ zero}$ of the fixed zero provided by the frequency compensation circuit 390 of the prior art is lower than the unity gain frequency. In the region 910, the fixed zero reduces the magnitude of the phase [$\text{phase}(V_{out})-\text{phase}(V_{in+})$], preventing this phase from approaching −180 degrees prior to the unity gain frequency (otherwise the LDO regulator would become unstable and oscillate).

Here, the phase margin (PM) is measured at the frequency where the open-loop gain equals the closed-loop gain, whereas the closed-loop gain is 7 dB (i.e., closed-loop gain=A/(1+AB), A=25118 or 88 dB, B=0.4444 as described above). At the frequency where the open-loop gain=7 dB, the phase margin is 50 degrees (i.e., −130−(−180)). Even at the unity gain frequency, the phase margin is positive and is greater than a few degrees. Thus, in FIG. 9, the LDO regulator that includes the frequency compensation circuit 390 of the prior art is stable for the case when a small load resistance $R_{load}$ is coupled to the output terminal of the LDO regulator.

Figure 10:
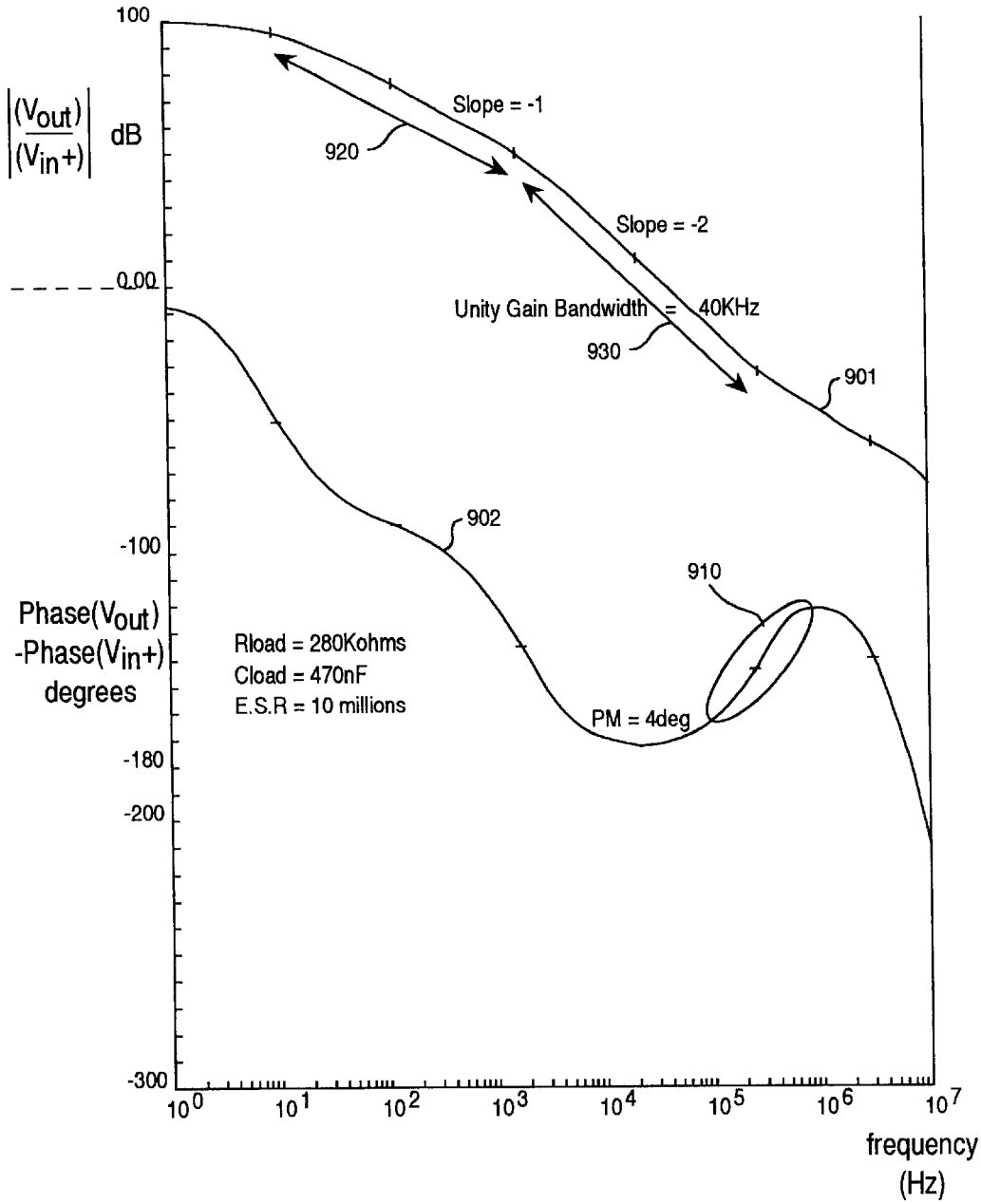
FIG. 10 illustrates a Bode plot of the gain and phase of the frequency response of the LDO regulator of FIG. 8, whereas a large load resistance is coupled to the output of the LDO regulator.

FIG. 10 illustrates a Bode plot of the gain and phase of the frequency response of the LDO regulator of FIG. 8 that includes the frequency compensation circuit 390 of the prior art, whereas a large load resistance $R_{load}$ is coupled to the output of the LDO regulator. The scale from 0 decibel to 100 decibels is utilized to plot the gain (i.e., the curve 901). The scale from 0 degrees to −300 degrees is utilized to plot the phase (i.e., the curve 902). The gain and the phase are determined as described with respect to FIG. 9.

For the simulation in FIG. 10 (which depicts the frequency response of the LDO regulator 200 of FIG. 8), the load resistance $R_{load}$ is 280 kiloOhms, the output capacitor (or load capacitor) $C_{output}$ is 470 nanofarads and ceramic, and the ESR of the output capacitor $C_{output}$ is 10 milliohms. In addition, the first feedback resistor R1 has a value of 65 kiloOhms while the second feedback resistor R2 has a value of 52 kiloOhms. Moreover, the compensation resistor $R_{zero}$ is 100 kiloOhms and the compensation capacitor $C_{zero}$ is 5 picofarads. Using the Eq. 2, the $\text{Frequency}_{pole\ A}$ of the pole at Node A is:

$\text{Frequency}_{pole\ A}$=1.2 Hz.

Similarly, using the Eq. 6, the $\text{Frequency}_{fixed\ zero}$ of the fixed zero provided by the frequency compensation circuit 390 of the prior art is:

$\text{Frequency}_{fixed\ zero}$=318,310 Hz.

Also, using the Eq. 3, the Frequency of the zero provided by the output capacitor $C_{output}$ and the ESR is:

Frequency=33,863,000 Hz.

As shown in FIG. 10, the unity gain frequency (i.e., when the gain is 0 dB) is 40 kilohertz. The Frequency of the zero provided by the output capacitor $C_{output}$ and the ESR is higher than the unity gain frequency. Moreover, the $\text{Frequency}_{fixed\ zero}$ of the fixed zero by the frequency compensation circuit 390 of the prior art is higher than the unity gain frequency. In the region 910, the fixed zero reduces the magnitude of the phase in a range of frequencies that is too high to influence the stability of the LDO regulator. Hence, these zeros fail to contribute to the stability of the LDO regulator and do not improve the phase margin of the LDO regulator in the range of frequencies below or near the unity gain frequency, allowing the phase to approach −180 degrees prior to the unity gain frequency (leading the LDO regulator to become unstable and to oscillate). In particular, the region 920 of the gain has a slope=−1, indicating the 20 decibels/decade decline in the gain and the associated degradation of the phase margin caused by a first pole prior to the unity gain frequency. Moreover, the region 930 of the gain has a slope=−2, indicating the 40 decibels/decade decline in the gain and the associated degradation of the phase margin caused by the first pole and a second pole.

Here, the phase margin (PM) is measured at the frequency where the open-loop gain equals the closed-loop gain, whereas the closed-loop gain is 7 dB. At the frequency where the open-loop gain=7 dB, the phase margin is 4 degrees (i.e., −176−(−180)). Since the phase margin is less than 15 degrees, the LDO regulator that includes the frequency compensation circuit 390 of the prior art has a poor transient response and stability problems for the case when a large load resistance $R_{load}$ is coupled to the output terminal of the LDO regulator.

Figure 11:
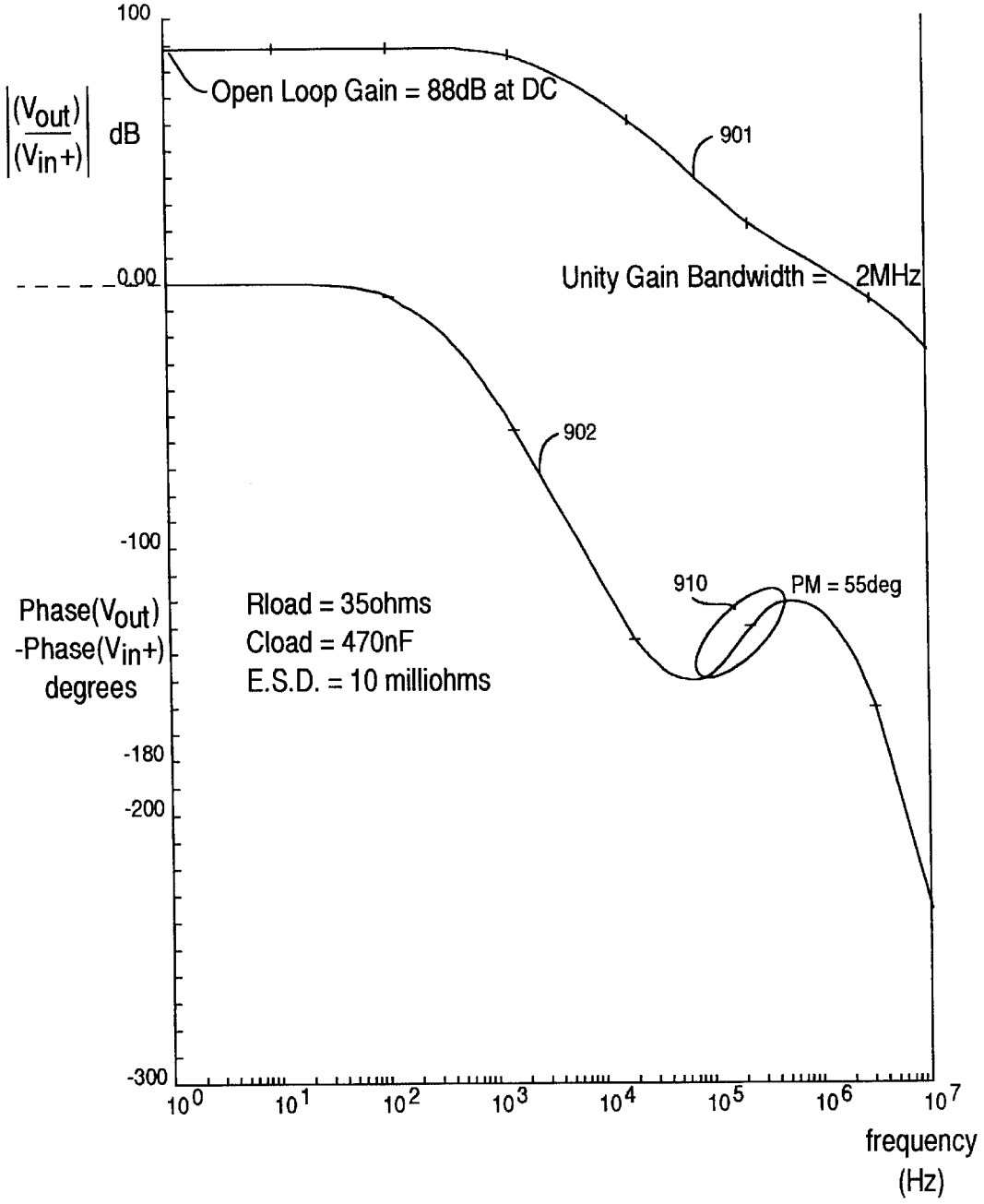
FIG. 11 illustrates a Bode plot of the gain and phase of the frequency response of the LDO regulator of FIG. 3, whereas a small load resistance is coupled to the output of the LDO regulator.

FIG. 11 illustrates a Bode plot of the gain and phase of the frequency response of the LDO regulator of FIG. 3 that includes the frequency compensation scheme of the present invention, whereas a small load resistance $R_{load}$ is coupled to the output of the LDO regulator. The scale from 0 decibel to 100 decibels is utilized to plot the gain (i.e., the curve 901). The scale from 0 degrees to −300 degrees is utilized to plot the phase (i.e., the curve 902). The gain is the open-loop gain of the LDO regulator of FIG. 3, measured in decibels. Referring to FIG. 3, the gain is determined by taking the ratio of the voltage at Node A ($V_{out}$) and the voltage at the noninverting input terminal of the error amplifier 250 ($V_{in+}$), whereas a sinusoidal voltage is applied to the noninverting input terminal of the error amplifier 250.

The phase is the difference between the phase of the voltage at Node A [phase($V_{out}$)] and the phase of the voltage at the noninverting input terminal of the error amplifier 250 [phase($V_{in+}$)].

For the simulation in FIG. 11 (which depicts the frequency response of the LDO regulator 200 of FIG. 3), the load resistance $R_{load}$ is 35 ohms, the output capacitor (or load capacitor) $C_{output}$ is 470 nanofarads and ceramic, and the ESR of the output capacitor $C_{output}$ is 10 milliohms. In addition, the first feedback resistor R1 has a value of 65 kiloOhms while the second feedback resistor R2 has a value of 52 kiloOhms, providing the feedback factor B=0.4444 (or 52000/(65000+52000)). In the adaptive zero frequency circuit 350, the compensation capacitor $C_{zero}$ is 5 picofarads (similar to the value of the compensation capacitor $C_{zero}$ used in FIGS. 9 and 10) and the resistance $R_{DS}$ of the variable resistance device varies with the output current $I_{out}$ which is related to the load resistance $R_{load}$ by the Eq. 1 above. For the simulation in FIG. 11, the resistance $R_{DS}$ is approximately 100 kiloOhms (similar to the value of the compensation resistor $R_{zero}$ used in FIGS. 9 and 10). As shown in FIG. 11, the DC gain A is 25118 or 88 dB. Using the Eq. 2, the Frequency$_{pole\ A}$ of the pole at Node A is:

Frequency$_{pole\ A}$=9,675 Hz.

Similarly, using the Eq. 4, the Frequency$_{zero}$ of the adaptive zero provided by the adaptive zero frequency circuit 350 (i.e., the compensation capacitor $C_{zero}$ and the resistance $R_{DS}$ of the variable resistance device) can be calculated and is approximately:

Frequency$_{zero}$=300 kilohertz.

Also, using the Eq. 3, the Frequency of the zero provided by the output capacitor $C_{output}$ and the ESR is:

Frequency=33,863,000 Hz.

As shown in FIG. 11, the unity gain frequency (i.e., when the gain is 0 dB) is 2.0 megahertz. The Frequency of the zero provided by the output capacitor $C_{output}$ and the ESR is higher than the unity gain frequency. Hence, this zero fails to contribute to the stability of the LDO regulator and does not improve the phase margin of the LDO regulator in the range of frequencies below or near the unity gain frequency. As discussed above, the LDO regulator 200 is stable and does not oscillate if when the gain response=1 at the unity gain frequency, the phase response is greater than −180 degrees (e.g., −100, −130, −150, etc.). Similarly, the LDO regulator 200 is stable and does not oscillate if when the phase response=−180 degrees at a particular frequency, the gain response is less than 1 at the particular frequency. Moreover, the phase margin (the amount of phase that is greater than −180 degrees) determines the transient response of the LDO regulator 200. If the phase margin is positive and is greater than a few degrees, the LDO regulator 200 is generally stable and has a transient response with reduced ringing and less parasitic excitations. If the phase margin is negative, the LDO regulator is generally unstable and oscillates.

As shown in FIG. 11, the Frequency$_{zero}$ of the adaptive zero provided by the adaptive zero frequency circuit 350 is lower than the unity gain frequency. In the region 910, the adaptive zero reduces the magnitude of the phase [phase($V_{out}$)−phase($V_{in+}$)], preventing this phase from approaching −180 degrees prior to the unity gain frequency (otherwise the LDO regulator would become unstable and oscillate).

Here, the phase margin (PM) is measured at the frequency where the open-loop gain equals the closed-loop gain, whereas the closed-loop gain is 7 dB (i.e., closed-loop gain=A/(1+AB), A=25118 or 88 dB, B=0.4444 as described above). At the frequency where the open-loop gain=7 dB, the phase margin is 55 degrees (i.e., −125−(−180)). Even at the unity gain frequency, the phase margin is positive and is greater than a few degrees. Thus, in FIG. 11, the LDO regulator that includes the frequency compensation scheme of the present invention is stable for the case when a small load resistance $R_{load}$ is coupled to the output terminal of the LDO regulator. Moreover, the frequency response of the LDO regulator (FIG. 8) of the prior art (as shown in FIG. 9) is comparable to the frequency response of the LDO regulator (FIG. 3) of the present invention (as shown in FIG. 11). However, the unity gain frequency and the phase margin of the LDO regulator (FIG. 3) of the present invention (as shown in FIG. 11) is greater than the unity gain frequency and the phase margin of the LDO regulator (FIG. 8) of the prior art (as shown in FIG. 9).

Figure 12:
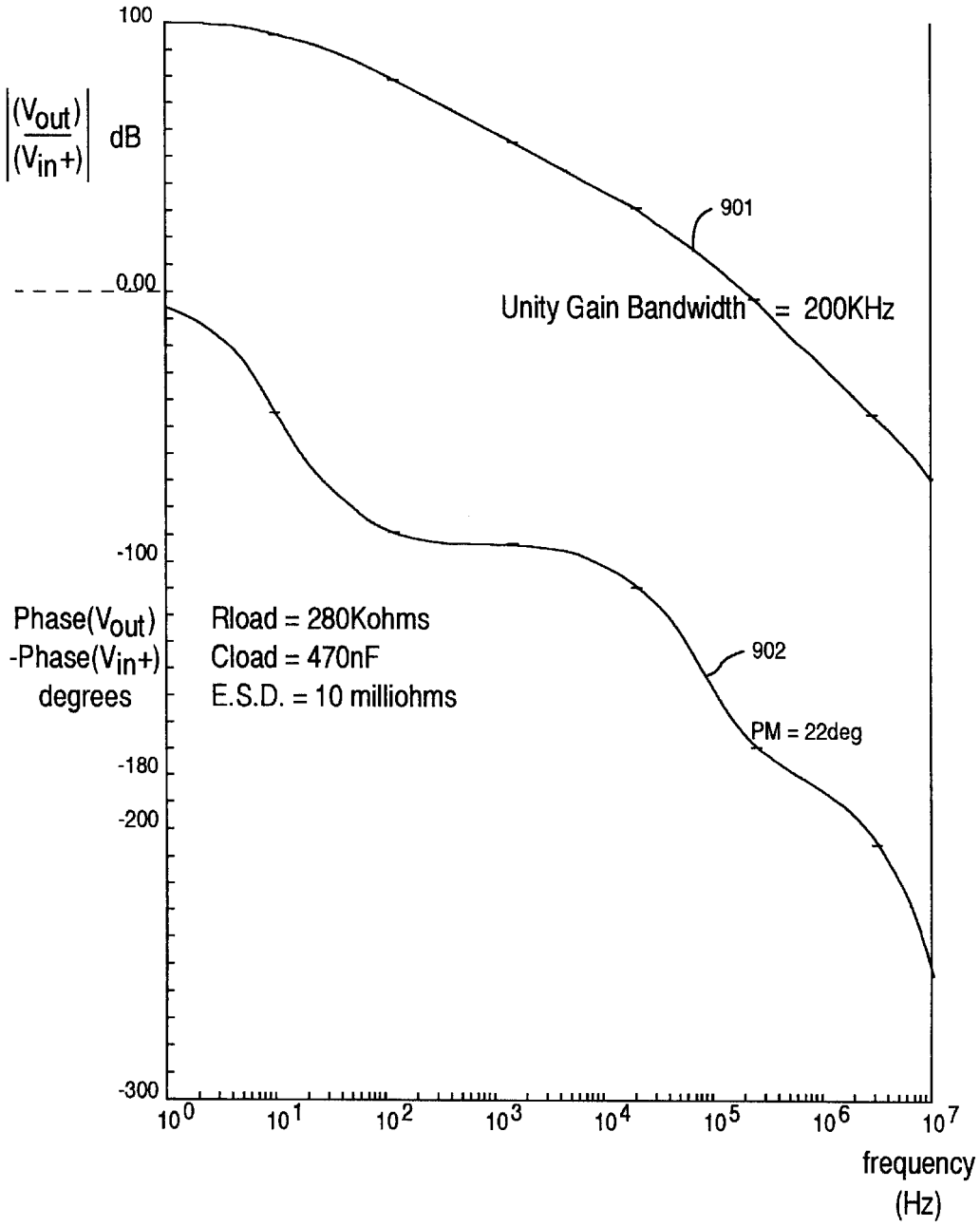
FIG. 12 illustrates a Bode plot of the gain and phase of the frequency response of the LDO regulator of FIG. 3, whereas a large load resistance is coupled to the output of the LDO regulator.

FIG. 12 illustrates a Bode plot of the gain and phase of the frequency response of the LDO regulator of FIG. 3 that includes the frequency compensation scheme of the present invention, whereas a large load resistance $R_{load}$ is coupled to the output of the LDO regulator. The scale from 0 decibel to 100 decibels is utilized to plot the gain (i.e., the curve 901). The scale from 0 degrees to −300 degrees is utilized to plot the phase (i.e., the curve 902). The gain and the phase are determined as described with respect to FIG. 11.

For the simulation in FIG. 12 (which depicts the frequency response of the LDO regulator 200 of FIG. 3), the load resistance $R_{load}$ is 280 kiloOhms, the output capacitor (or load capacitor) $C_{output}$ is 470 nanofarads and ceramic, and the ESR of the output capacitor $C_{output}$ is 10 milliohms. In addition, the first feedback resistor R1 has a value of 65 kiloOhms while the second feedback resistor R2 has a value of 52 kiloOhms. In the adaptive zero frequency circuit 350, the compensation capacitor $C_{zero}$ is 5 picofarads (similar to the value of the compensation capacitor $C_{zero}$ used in FIGS. 9, 10, and 11) and the resistance $R_{DS}$ of the variable resistance device varies with the output current $I_{out}$ which is related to the load resistance $R_{load}$ by the Eq. 1 above. For the simulation in FIG. 12, the resistance $R_{DS}$ is approximately several hundred kiloOhms. Using the Eq. 2, the Frequency$_{pole\ A}$ of the pole at Node A is:

Frequency$_{pole\ A}$=1.2 Hz.

Similarly, using the Eq. 4, the Frequency$_{zero}$ of the adaptive zero provided by the adaptive zero frequency circuit 350 (i.e., the compensation capacitor $C_{zero}$ and the resistance $R_{DS}$ of the variable resistance device) can be calculated and is approximately:

Frequency$_{zero}$<100 kilohertz.

Also, using the Eq. 3, the Frequency of the zero provided by the output capacitor $C_{output}$ and the ESR is:

Frequency=33,863,000 Hz.

As shown in FIG. 12, the unity gain frequency (i.e., when the gain is 0 dB) is 200 kilohertz. The Frequency of the zero provided by the output capacitor $C_{output}$ and the ESR is higher than the unity gain frequency. Hence, this zero fails to contribute to the stability of the LDO regulator and does not improve the phase margin of the LDO regulator in the range of frequencies below or near the unity gain frequency.

As shown in FIG. 12, the Frequency$_{zero}$ of the adaptive zero provided by the adaptive zero frequency circuit 350 is lower than the unity gain frequency. The adaptive zero reduces the magnitude of the phase [phase($V_{out}$)−phase($V_{in+}$)], preventing this phase from approaching −180 degrees prior to the unity gain frequency (otherwise the LDO regulator would become unstable and oscillate).

Here, the phase margin (PM) is measured at the frequency where the open-loop gain equals the closed-loop gain, whereas the closed-loop gain is 7 dB. At the frequency where the open-loop gain=7 dB, the phase margin is 22 degrees (i.e., −158–(−180)). Even at the unity gain frequency, the phase margin is positive and is greater than a few degrees. Unlike the LDO regulator (FIG. 8) that includes the frequency compensation circuit of the prior art and a ceramic output capacitor $C_{output}$, the LDO regulator (FIG. 3) that includes a ceramic output capacitor $C_{output}$ and the frequency compensation scheme of the present invention is stable for the case when a large load resistance $R_{load}$ is coupled to the output terminal of the LDO regulator. Thus, the LDO regulator (FIG. 3) that includes the frequency compensation scheme of the present invention is stable and has a sufficient phase margin for an acceptable transient response under a range of values for the output current and the load resistance $R_{load}$.

Lastly, the unity gain frequency and the phase margin of the LDO regulator (FIG. 3) of the present invention (as shown in FIG. 12) is greater than the unity gain frequency and the phase margin of the LDO regulator (FIG. 8) of the prior art (as shown in FIG. 10).

Figure 13A:
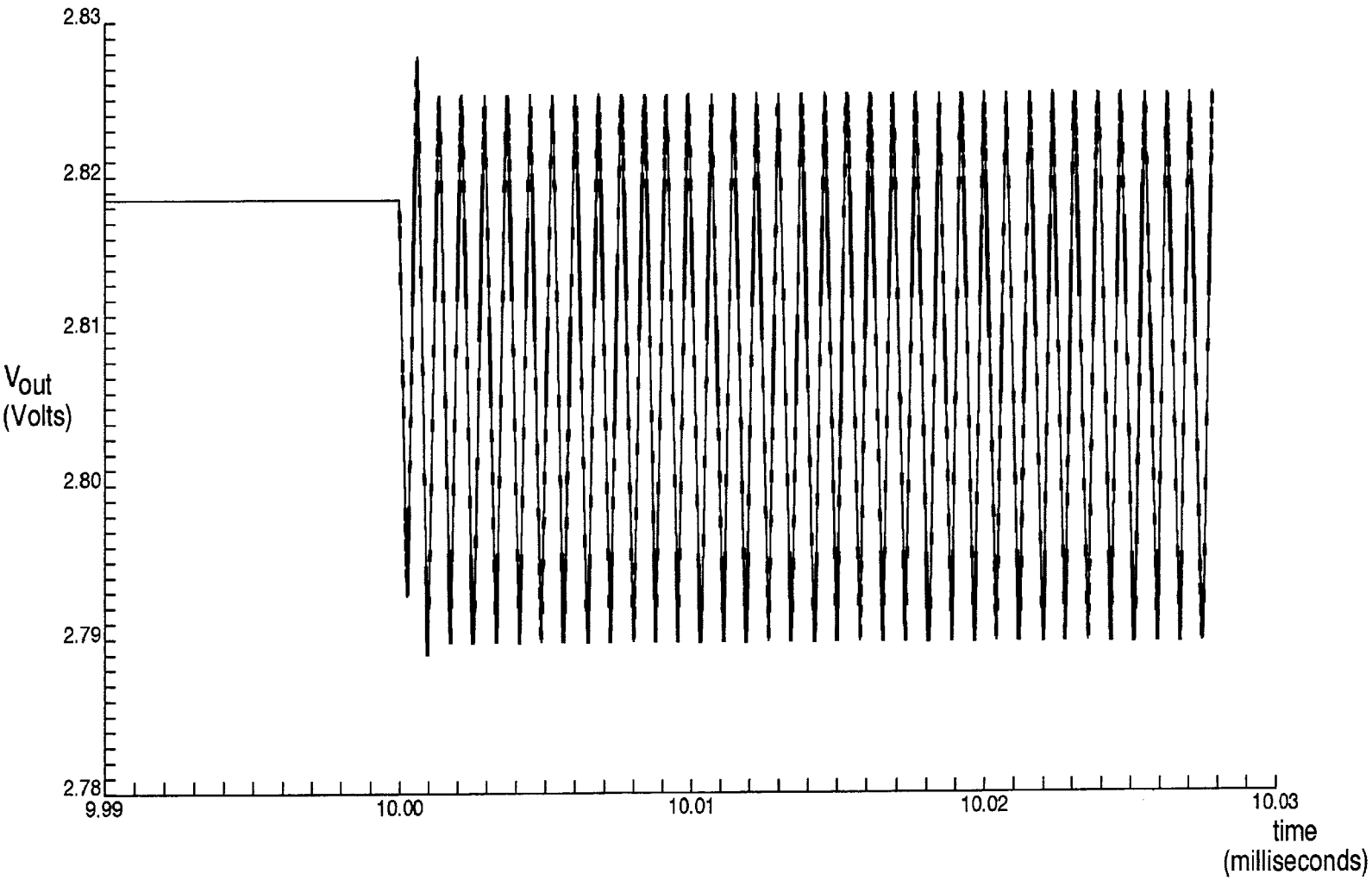
FIGS. 13A and 13B illustrate voltage and current graphs, showing the transient response of the LDO regulator of FIG. 8.
Figure 13B:
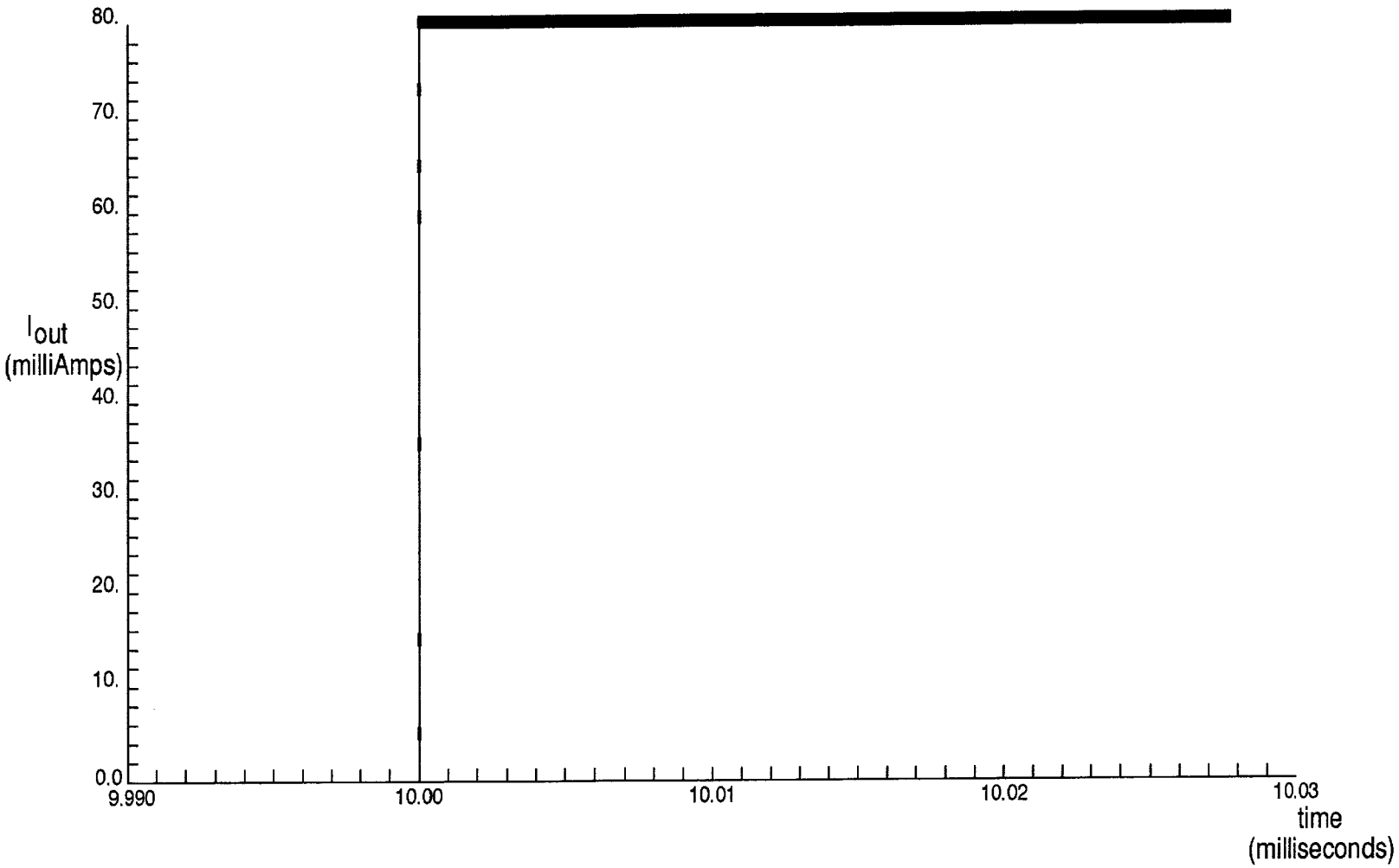

FIGS. 13A and 13B illustrate voltage and current graphs, showing the transient response of the LDO regulator of FIG. 8 that includes the frequency compensation circuit of the prior art and a ceramic output capacitor $C_{output}$. In FIG. 13B, the LDO regulator of FIG. 8 experiences a worst-case situation since the output current $I_{out}$ suddenly steps from 0 amps to 80 milliamps (e.g., due to switching from a small load resistance to a large load resistance). In FIG. 13A, the regulated output voltage $V_{out}$ of the LDO regulator of FIG. 8 is illustrate. As shown in FIG. 13A, the LDO regulator of FIG. 8 attempts to adjust the regulated output voltage $V_{out}$ after the change in the output current $I_{out}$ so that to return to a steady state. However, the regulated output voltage $V_{out}$ of the LDO regulator of FIG. 8 enters a state of oscillation (due to the degraded phase margin illustrated in FIG. 10) and never reaches a steady state.

Figure 14A:
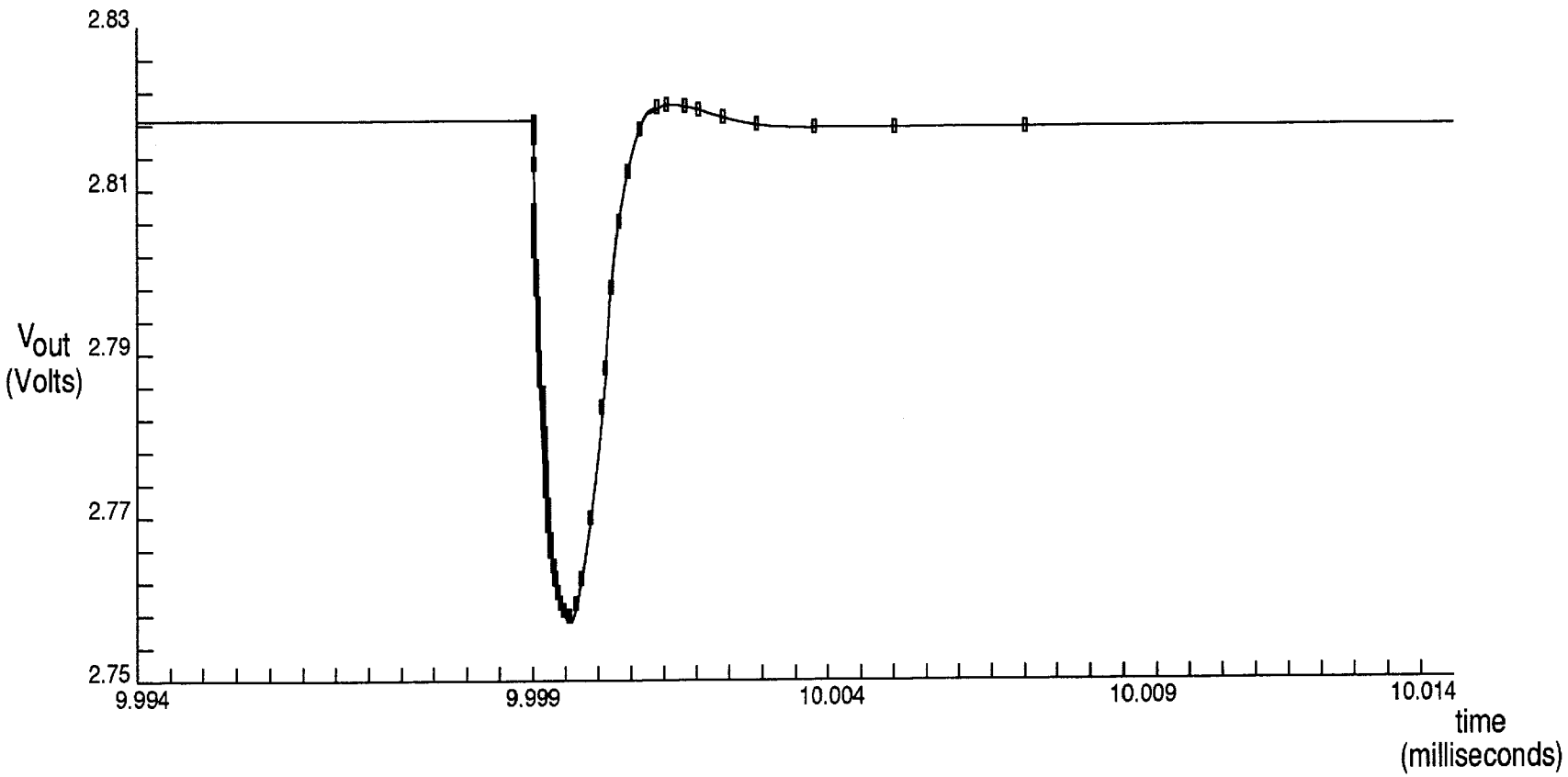
FIGS. 14A and 14B illustrate voltage and current graphs, showing the transient response of the LDO regulator of FIG. 3.
Figure 14B:
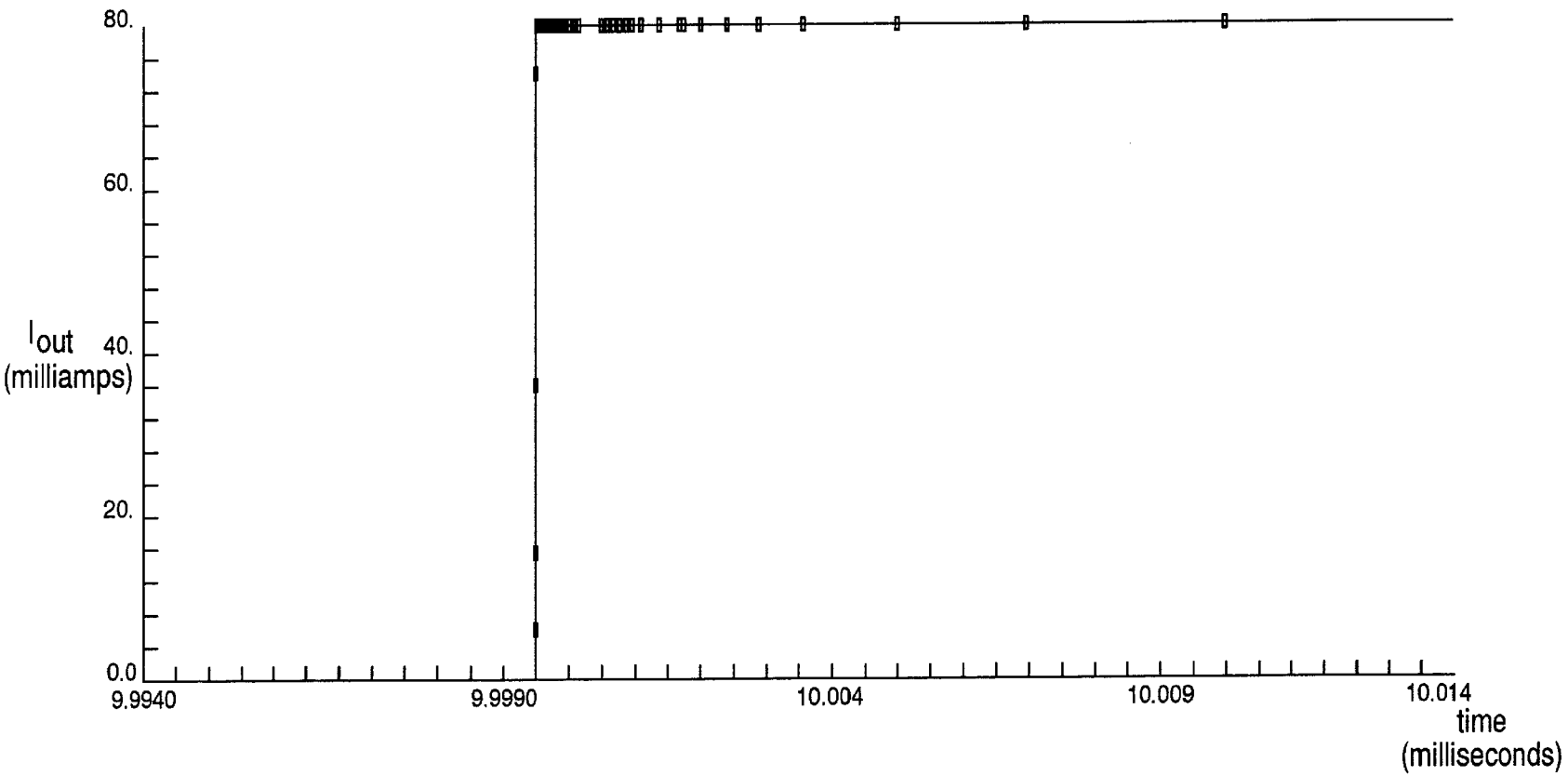

FIGS. 14A and 14B illustrate voltage and current graphs, showing the transient response of the LDO regulator of FIG. 3 that includes the frequency compensation scheme of the present invention and a ceramic output capacitor $C_{output}$. In FIG. 14B, the LDO regulator of FIG. 3 experiences a worst-case situation since the output current $I_{out}$ suddenly steps from 0 amps to 80 milliamps (e.g., due to switching from a small load resistance to a large load resistance). In FIG. 14A, the regulated output voltage $V_{out}$ of the LDO regulator of FIG. 3 is illustrate. As shown in FIG. 14A, the LDO regulator of FIG. 8 attempts to adjust the regulated output voltage $V_{out}$ after the change in the output current $I_{out}$ so that to return to a steady state. As illustrated in FIG. 14A, the regulated output voltage $V_{out}$ has a small dip caused by the time period required to respond to the change in the output current $I_{out}$. Moreover, the regulated output voltage $V_{out}$ has a slight overshoot (determined by the phase margins in FIGS. 11 and 12). Unlike the regulated output voltage $V_{out}$ of the LDO regulator of FIG. 8 of the prior art, the regulated output voltage $V_{out}$ of the LDO regulator of FIG. 3 of the present invention reaches a steady state rapidly and responds quickly to the change in the output current $I_{out}$.

The foregoing descriptions of specific embodiments of the present invention have been presented for purposes of illustration and description. They are not intended to be exhaustive or to limit the invention to the precise forms disclosed, and obviously many modifications and variations are possible in light of the above teaching. The embodiments were chosen and described in order to best explain the principles of the invention and its practical application, to thereby enable others skilled in the art to best utilize the invention and various embodiments with various modifications as are suited to the particular use contemplated. It is intended that the scope of the invention be defined by the Claims appended hereto and their equivalents.

What is claimed is:

1. A frequency compensation circuit for a low dropout voltage (LDO) regulator having an amplifying stage and a pass device stage, comprising:

a current sensing circuit coupled to said pass device stage, said current sensing circuit generating a sense current that varies with an output current generated by said pass device stage; and an adaptive zero frequency (AZF) circuit coupled to said current sensing circuit, coupled to a ground terminal of said LDO regulator, and coupled to an output terminal of said amplifying stage, wherein said AZF circuit provides a zero in a transfer function equation associated with a frequency response of said LDO regulator, and wherein said zero is located at a frequency which varies with said sense current so that to maintain stability in said LDO regulator and to improve transient response of said LDO regulator under a range of values for said output current.

2. A frequency compensation circuit as recited in claim 1 wherein said adaptive zero frequency (AZF) circuit comprises a variable resistance device having a resistance which inversely varies with a bias parameter, a capacitor coupled to said variable resistance device, and a bias circuit coupled to said variable resistance device for generating said bias parameter in response to said sense current, wherein said zero is generated by said variable resistance device in series with said capacitor, and wherein said resistance inversely varies with said sense current.

3. A frequency compensation circuit as recited in claim 2 wherein said capacitor comprises an integrated circuit (IC) capacitor.

4. A frequency compensation circuit as recited in claim 2 wherein said variable resistance device comprises a n-channel MOSFET (NMOS) having a drain, a source, and a gate.

5. A frequency compensation circuit as recited in claim 4 wherein said bias circuit comprises a second n-channel MOSFET (NMOS) having a second drain coupled to said current sensing circuit to receive said sense current, a second source coupled to said ground terminal, and a second gate coupled to said second drain, and wherein said gate is coupled to said second gate.

6. A frequency compensation circuit as recited in claim 4 wherein said capacitor includes a first terminal and a second terminal, wherein said first terminal is coupled to said output terminal of said amplifying stage, wherein said drain is coupled to said second terminal, wherein said gate is coupled to said bias circuit such that said bias circuit biases said NMOS in a linear region, wherein said source is coupled to said ground terminal, and wherein said bias parameter comprises a voltage between said gate and said source.

7. A frequency compensation circuit as recited in claim 2 wherein said variable resistance device comprises a p-channel MOSFET (PMOS) having a PMOS drain, a PMOS source, and a PMOS gate.

8. A frequency compensation circuit as recited in claim 7 wherein said bias circuit comprises:

a n-channel MOSFET (NMOS) having a NMOS drain coupled to said current sensing circuit to receive said sense current, a NMOS source coupled to said ground terminal, and a NMOS gate coupled to said NMOS drain;

a second n-channel MOSFET (NMOS) having a second NMOS drain, a second NMOS source coupled to said ground terminal, and a second NMOS gate coupled to said NMOS gate;

a second p-channel MOSFET (PMOS) having a second PMOS drain coupled to said second NMOS drain, a second PMOS source, and a second PMOS gate coupled to said second PMOS drain, wherein said PMOS gate is coupled to said second PMOS gate; and a secondary biasing circuit coupled to said second PMOS source.

9. A frequency compensation circuit as recited in claim 7 wherein said capacitor includes a first terminal and a second terminal, wherein said first terminal is coupled to said ground terminal, wherein said PMOS drain is coupled to said second terminal, wherein said PMOS gate is coupled to said bias circuit such that said bias circuit biases said PMOS in a linear region, wherein said PMOS source is coupled to said output terminal of said amplifying stage, and wherein said bias parameter comprises a voltage between said PMOS gate and said PMOS source.

10. A frequency compensation circuit as recited in claim 1 wherein said pass device stage comprises a power p-channel MOSFET which generates said output current.

11. A frequency compensation circuit as recited in claim 1 wherein said pass device stage comprises a power PNP transistor which generates said output current.

12. A frequency compensation circuit as recited in claim 1 wherein said current sensing circuit comprises a p-channel MOSFET.

13. A frequency compensation circuit as recited in claim 1 wherein said LDO regulator includes an output and an output capacitor coupled between said output and said ground terminal, wherein said output capacitor includes an equivalent series resistance (ESR), and wherein said stability of said LDO regulator is minimally dependent on said ESR.

14. A frequency compensation circuit as recited in claim 13 wherein said output capacitor comprises a ceramic capacitor.

15. A low dropout voltage (LDO) regulator comprising:

an error amplifier having an amplifying stage and a pass device stage, said error amplifier generating a regulated voltage at an output of said LDO regulator;

a current sensing circuit coupled to said pass device stage, said current sensing circuit generating a sense current that varies with an output current generated by said pass device stage at said output of said LDO regulator; and an adaptive zero frequency (AZF) circuit coupled to said current sensing circuit, coupled to a ground terminal of said LDO regulator, and coupled to an output terminal of said amplifying stage, wherein said AZF circuit provides a zero in a transfer function equation associated with a frequency response of said LDO regulator, and wherein said zero is located at a frequency which varies with said sense current so that to maintain stability in said LDO regulator and to improve transient response of said LDO regulator under a range of values for said output current.

16. A low dropout voltage (LDO) regulator as recited in claim 15 wherein said adaptive zero frequency (AZF) circuit comprises a variable resistance device having a resistance which inversely varies with a bias parameter, a capacitor coupled to said variable resistance device, and a bias circuit coupled to said variable resistance device for generating said bias parameter in response to said sense current, wherein said zero is generated by said variable resistance device in series with said capacitor, and wherein said resistance inversely varies with said sense current.

17. A low dropout voltage (LDO) regulator as recited in claim 16 wherein said capacitor comprises an integrated circuit (IC) capacitor.

18. A low dropout voltage (LDO) regulator as recited in claim 16 wherein said variable resistance device comprises a n-channel MOSFET (NMOS) having a drain, a source, and a gate.

19. A low dropout voltage (LDO) regulator as recited in claim 18 wherein said bias circuit comprises a second n-channel MOSFET (NMOS) having a second drain coupled to said current sensing circuit to receive said sense current, a second source coupled to said ground terminal, and a second gate coupled to said second drain, and wherein said gate is coupled to said second gate.

20. A low dropout voltage (LDO) regulator as recited in claim 18 wherein said capacitor includes a first terminal and a second terminal, wherein said first terminal is coupled to said output terminal of said amplifying stage, wherein said drain is coupled to said second terminal, wherein said gate is coupled to said bias circuit such that said bias circuit biases said NMOS in a linear region, wherein said source is coupled to said ground terminal, and wherein said bias parameter comprises a voltage between said gate and said source.

21. A low dropout voltage (LDO) regulator as recited in claim 16 wherein said variable resistance device comprises a p-channel MOSFET (PMOS) having a PMOS drain, a PMOS source, and a PMOS gate.

22. A low dropout voltage (LDO) regulator as recited in claim 21 wherein said bias circuit comprises:

a n-channel MOSFET (NMOS) having a NMOS drain coupled to said current sensing circuit to receive said sense current, a NMOS source coupled to said ground terminal, and a NMOS gate coupled to said NMOS drain;

a second n-channel MOSFET (NMOS) having a second NMOS drain, a second NMOS source coupled to said ground terminal, and a second NMOS gate coupled to said NMOS gate;

a second p-channel MOSFET (PMOS) having a second PMOS drain coupled to said second NMOS drain, a second PMOS source, and a second PMOS gate coupled to said second PMOS drain, wherein said PMOS gate is coupled to said second PMOS gate; and a secondary biasing circuit coupled to said second PMOS source.

23. A low dropout voltage (LDO) regulator as recited in claim 21 wherein said capacitor includes a first terminal and a second terminal, wherein said first terminal is coupled to said ground terminal, wherein said PMOS drain is coupled to said second terminal, wherein said PMOS gate is coupled to said bias circuit such that said bias circuit biases said PMOS in a linear region, wherein said PMOS source is coupled to said output terminal of said amplifying stage, and wherein said bias parameter comprises a voltage between said PMOS gate and said PMOS source.

24. A low dropout voltage (LDO) regulator as recited in claim 15 wherein said pass device stage comprises a power p-channel MOSFET which generates said output current.

25. A low dropout voltage (LDO) regulator as recited in claim 15 wherein said pass device stage comprises a power PNP transistor which generates said output current.

26. A low dropout voltage (LDO) regulator as recited in claim 15 wherein said current sensing circuit comprises a p-channel MOSFET.

27. A low dropout voltage (LDO) regulator as recited in claim 15 further comprising an output capacitor coupled between said output and said ground terminal, wherein said output capacitor includes an equivalent series resistance (ESR), and wherein said stability of said LDO regulator is minimally dependent on said ESR.

28. A low dropout voltage (LDO) regulator as recited in claim 27 wherein said output capacitor comprises a ceramic capacitor.

29. A method of frequency compensating a low dropout voltage (LDO) regulator having an amplifying stage and a pass device stage, said method comprising the steps of:

a) providing a capacitor and a variable resistance device in series between a ground terminal of said LDO regulator and an output terminal of said amplifying stage, wherein said variable resistance device has a resistance which inversely varies with a bias parameter;

b) sensing an output current generated by said pass device stage;

c) generating a sense current that varies with said output current; and d) generating said bias parameter for said variable resistance device in response to said sense current, wherein said resistance inversely varies with said sense current.

30. A method as recited in claim 29 wherein said variable resistance device in series with said capacitor provide a zero in a transfer function equation associated with a frequency response of said LDO regulator, and wherein said zero is located at a frequency which varies with said sense current so that to maintain stability in said LDO regulator and to improve transient response of said LDO regulator under a range of values for said output current.

31. A method as recited in claim 29 wherein said variable resistance device comprises a n-channel MOSFET (NMOS), wherein said NMOS is coupled to said ground terminal and is coupled to said capacitor, and wherein said capacitor is coupled to said output terminal.

32. A method as recited in claim 29 wherein said variable resistance device comprises a p-channel MOSFET (PMOS), wherein said PMOS is coupled to said output terminal and is coupled to said capacitor, and wherein said capacitor is coupled to said ground terminal.

33. A method as recited in claim 29 wherein said pass device stage comprises a power p-channel MOSFET which generates said output current.

34. A method as recited in claim 29 wherein said pass device stage comprises a power PNP transistor which generates said output current.

35. A method as recited in claim 29 wherein said LDO regulator further includes an output capacitor coupled between an output of said LDO regulator and said ground terminal, wherein said output capacitor includes an equivalent series resistance (ESR), and wherein stability of said LDO regulator is minimally dependent on said ESR.

36. A method as recited in claim 35 wherein said output capacitor comprises a ceramic capacitor.

37. A method as recited in claim 29 wherein said steps b) and c) are performed by a p-channel MOSFET.

* * * * *